US007740191B2

(12) United States Patent
Ohashi et al.

(10) Patent No.: US 7,740,191 B2
(45) Date of Patent: Jun. 22, 2010

(54) SHOWER DEVICE AND SHOWER BOOTH

(75) Inventors: Takahiro Ohashi, Kanagawa-ken (JP); Ryoko Ishimaru, Kanagawa-ken (JP); Kazuki Kuroda, Kanagawa-ken (JP)

(73) Assignee: Toto Ltd. (JP)

( * ) Notice: Subject to any disclaimer, the term of this patent is extended or adjusted under 35 U.S.C. 154(b) by 166 days.

(21) Appl. No.: 11/681,296

(22) Filed: Mar. 2, 2007

(65) Prior Publication Data

US 2007/0252018 A1 Nov. 1, 2007

(30) Foreign Application Priority Data

Mar. 2, 2006 (JP) ..... 2006-056992

(51) Int. Cl.

| | |
|---|---|
| ***B05B 15/06*** | (2006.01) |
| *B05B 3/06* | (2006.01) |
| *B05B 3/04* | (2006.01) |
| *B05B 1/34* | (2006.01) |
| *B05B 3/00* | (2006.01) |
| *B05B 3/02* | (2006.01) |
| *B05B 3/16* | (2006.01) |
| *B05B 1/36* | (2006.01) |
| *A62C 31/00* | (2006.01) |

(52) U.S. Cl. ..... 239/282; 239/255; 239/381; 239/383; 239/463; 239/225.1; 239/222.15; 239/242; 239/263; 239/443; 239/193; 418/68

(58) Field of Classification Search ..... 239/282, 239/255, 381, 383, 463, 225.1, 222.15, 222.11, 239/380, 240, 242, 263, 548, 443, 193, 194; 418/68

See application file for complete search history.

(56) References Cited

U.S. PATENT DOCUMENTS

| | | | | | |
|---|---|---|---|---|---|
| 3,880,357 | A | * | 4/1975 | Baisch | 239/380 |
| 3,902,664 | A | * | 9/1975 | Deines | 239/99 |
| 4,220,284 | A | | 9/1980 | Beiswenger et al. | |
| 4,428,532 | A | * | 1/1984 | Holden-Parker | 239/204 |
| 4,651,720 | A | | 3/1987 | Baus | |
| 4,665,944 | A | * | 5/1987 | Wallace et al. | 137/580 |
| 5,035,010 | A | | 7/1991 | Sakamoto et al. | |
| 5,321,860 | A | * | 6/1994 | Steinhardt et al. | 4/601 |
| 6,148,453 | A | * | 11/2000 | Sartor | 4/615 |

(Continued)

FOREIGN PATENT DOCUMENTS

| | | |
|---|---|---|
| JP | 62-066757 | 4/1987 |

(Continued)

OTHER PUBLICATIONS

Office Action received for Japanese Application No. 2007-540444, mailed Jul. 28, 2008.

*Primary Examiner*—Dihh Q Nguyen
*Assistant Examiner*—Steven Cernoch
(74) *Attorney, Agent, or Firm*—Banner & Witcoff, Ltd.

(57) ABSTRACT

A shower device includes: a driving unit including a housing and a core allowed to reciprocate by water which is introduced into the housing; a shower part allowed to swing; a water guide channel introducing water which is introduced into the housing to the shower part; and a power transmission part transmitting a motion of the core to the shower part. The shower part sprinkles water while swinging when water is introduced into the housing.

12 Claims, 42 Drawing Sheets

U.S. PATENT DOCUMENTS

| | | | | |
|---|---|---|---|---|
| 6,908,047 | B2 * | 6/2005 | Saunders et al. | 239/225.1 |
| 7,014,128 | B2 * | 3/2006 | Leung | 239/461 |
| 2004/0124281 | A1 | 7/2004 | Leung | |

FOREIGN PATENT DOCUMENTS

| | | |
|---|---|---|
| JP | 63-3826 | 1/1988 |
| JP | 63-071229 | 3/1988 |
| JP | 02-134119 | 5/1990 |
| JP | 03-007127 | 1/1991 |
| JP | 3-28208 | 4/1991 |
| JP | 04-028866 | 3/1992 |
| JP | 04-046819 | 11/1992 |
| JP | 3047060 | 1/1998 |
| JP | 2002-285620 | 10/2002 |

* cited by examiner (a)

(b)

SHOWER DEVICE AND SHOWER BOOTH

CROSS-REFERENCE TO RELATED APPLICATIONS

This application is based upon and claims the benefit of priority from the prior Japanese Patent Application No. 2006-056992, filed on Mar. 2, 2006; the entire contents of which are incorporated herein by reference.

BACKGROUND OF THE INVENTION

1. Field of the Invention

This invention relates to a shower device for use in a bathroom or a shower booth, capable of automatic reciprocating action for repetitively changing the water sprinkle direction of the shower, and a shower booth.

2. Description of the Related Art

There are growing needs for shower devices intended for relaxation, beauty/health enhancement and the like. In an approach for this application, for example, swirling flow or the like is used to modulate water flow at a relatively fast rate of several tens of hertz or more for enhancing massage effect and the like. On the other hand, the water sprinkle position and water sprinkle direction of a shower nozzle or the like can be repetitively changed at a relatively slow rate of several hertz or less, for example, to uniformly spray water onto a prescribed area of a human body for enhancing relaxation effect and the like.

Electrically-operated means such as a motor or solenoid can also be used for reciprocating action. However, for installing such means into a system for discharging water in a bathroom or the like, it is necessary to ensure power supply and to take measures against electric shock and leakage and the like. There are also many problems to be solved with regard to cost and reliability.

In this respect, if reciprocating action can be achieved hydraulically, the need for electricity, lubricating oil and the like is eliminated, and improvement can be expected in many aspects such as initial cost, running cost, reliability, and maintainability.

A shower device capable of vertical reciprocating action is disclosed (Japanese Patent Application Publication No. HO 2-134119A), where a piston is combined with a four-way valve. In this shower device, a piston provided in a cylinder is moved vertically by hydraulic pressure, and a shower head is moved vertically through a wire. The vertical motion of the piston is switched by switching the water supply channel to the cylinder using the four-way valve.

It can be said that a driving device using water pressure from combination of a cylinder like this and a piston can attain directly driving force with a low speed and a high power as motion of the piston, compared with a driving device obtaining driving force by rotating a water mill with a high speed, and is suitable for use as the shower device which needs a stable motion as naked humans touches directly. That is, if considering about a usage pattern, as the device is set so as to be directly touchable for a user, rigidity is needed for the shower head itself not so as to break when the user collides with the shower head accidentally, and high driving force is needed for move the shower head. Furthermore, the low speed is preferred to get a comfortable feeling of use of the shower. The water pressure driving device from combination of the cylinder and the piston can transmit the high driving force to the shower head and can easily drive the shower head with the low speed, compared with the water pressure driving device using the water mill.

However, in the case of this shower device, as the shower head is moved vertically, a long distance for moving the shower head is necessary to discharge water in a broad area. As a result, an area being possible for the shower head to exist broadens and there is a problem of resulting in a design impairment when setting the shower device in the limited space such as a bathroom and a shower booth.

This invention has been made in consideration of these problems. An object of the invention is to provide a shower device and a shower booth having a compact and simple structure, a reduced area being possible for the shower head to exist in spite of keeping capability of discharging water in the broad area, and improved design.

SUMMARY OF THE INVENTION

According to an aspect of the invention, there is provided a shower device including: a driving unit including a housing and a core allowed to reciprocate by water which is introduced into the housing; a shower part allowed to swing; a water guide channel introducing water which is introduced into the housing to the shower part; and a power transmission part transmitting a motion of the core to the shower part, the shower part sprinkling water while swinging when water is introduced into the housing.

According to another aspect of the invention, there is provided a shower booth including: a wall; a ceiling; and the above-described shower device provided on at least one of the wall and the ceiling.

DETAILED DESCRIPTION

Figure 1:
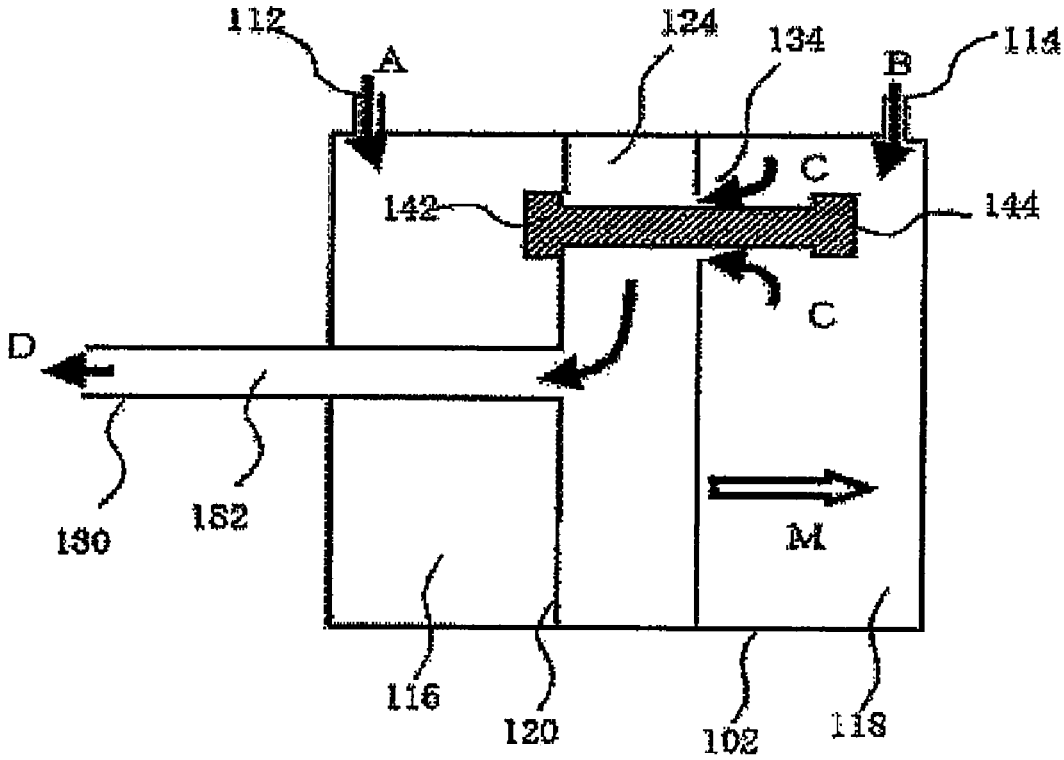
FIG. 1 is a schematic view for describing the mechanism of driving unit 100.
Figure 2:
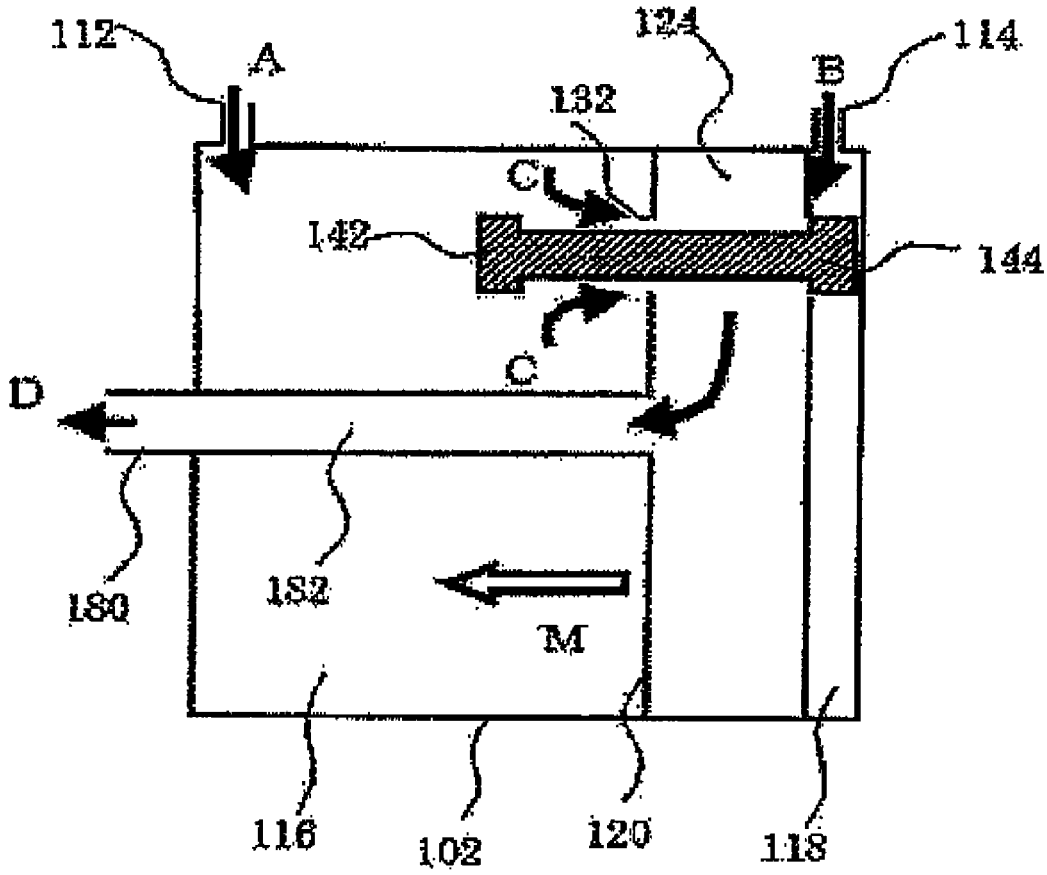
FIG. 2 is a schematic view for describing the mechanism of driving unit 100.
Figure 3:
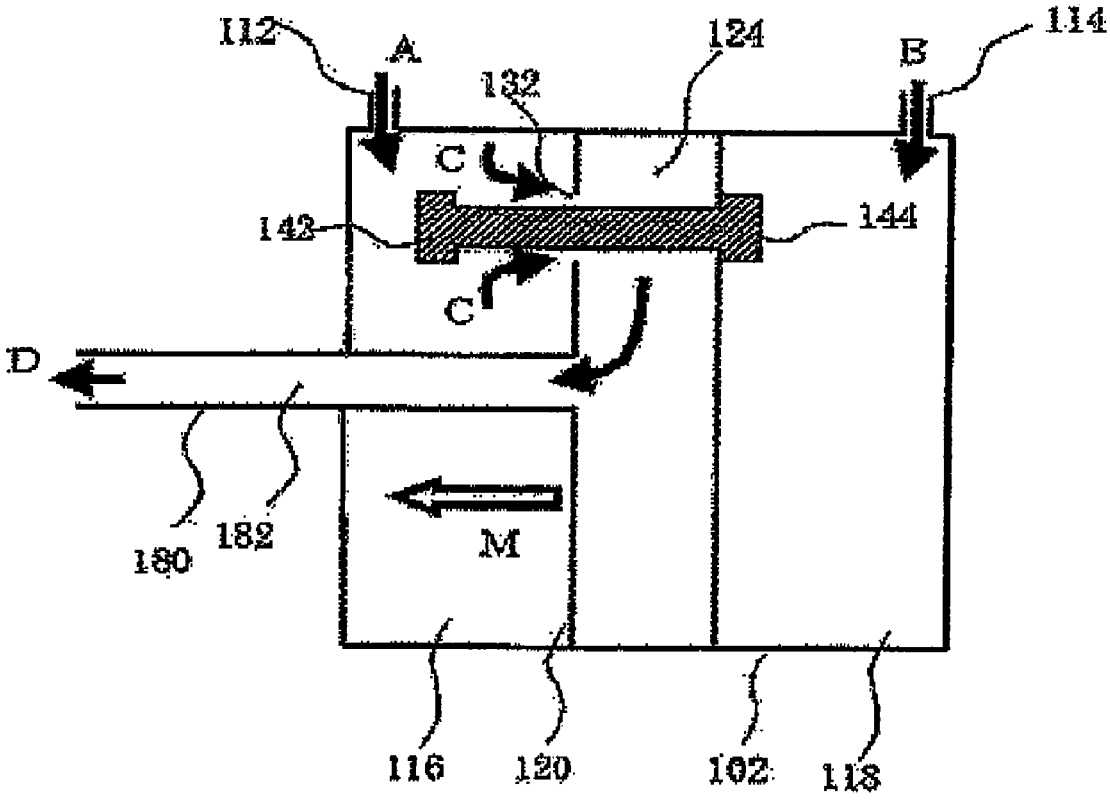
FIG. 3 is a schematic view for describing the mechanism of driving unit 100.

Embodiment of the invention will now be described with reference to the drawings.

Firstly, the structure and the mechanism of driving unit 100 provided in the shower device of the embodiment are described in detail. FIGS. 1 to 4 are schematic views for describing the mechanism of driving unit 100 of the embodiment. In addition, for convenience, driving unit 100 is horizontally oriented, and core 120 and water discharge tubular body 180 are allowed to reciprocate horizontally in-plane of the paper.

More specifically, driving unit 100 has housing 102 and water discharge tubular body 180 protruding from housing 102. Inside water discharge tubular body 180 is provided water discharge channel 182. Housing 102 has two water inlet ports 112, 114. Water inlet ports 112, 114 are coupled in parallel. When water (including hot water and cold water) is supplied to water inlet ports 112, 114 at nearly the same pressure, water discharge tubular body 180 discharges water from water discharge channel 182 while reciprocating right and left as shown by arrow M.

Driving unit 100 has core 120 movably provided in housing 102. The interior of housing 102 is divided by core 120 into a first pressure chamber 116 and a second pressure chamber 118. Core 120 has a hollow structure. The hollow space constitutes core inner channel 124 communicating with water discharge channel 182 provided in water discharge tubular body 180. Core inner channel 124 communicates with pressure chambers 116, 118 via introducing ports (drain hole) 132, 134, respectively.

Core 120 is provided with valve bodies 142, 144 for changing the opening of introducing ports 132, 134. Core 120 is also provided with a control means for controlling valve bodies 142, 144. The control means can produce an opening difference between introducing ports 132 and 134, thereby causing a difference in channel resistance between the right and left channel extending from the water inlet port to core inner channel 124. The resulting pressure difference between right and left pressure chamber 116, 118 can be used to move core 120.

In the state shown in FIG. 1, the control means causes valve bodies 142, 144 to be biased to the right end, and introducing port 134 for water is opened on the right side of core 120. Therefore the water supplied from water inlet port 114 flows from pressure chamber 118 into core inner channel 124 of core 120 along the path shown by arrow C, passes through water discharge channel 182 provided in water discharge tubular body 180, and flows out as shown by arrow D. On the other hand, because the water supplied from water inlet port 112 of the housing has no outflow path, the pressure in pressure chamber 116 becomes higher than the pressure in pressure chamber 118. As a result, core 120 moves in the direction of arrow M.

Figure 5:
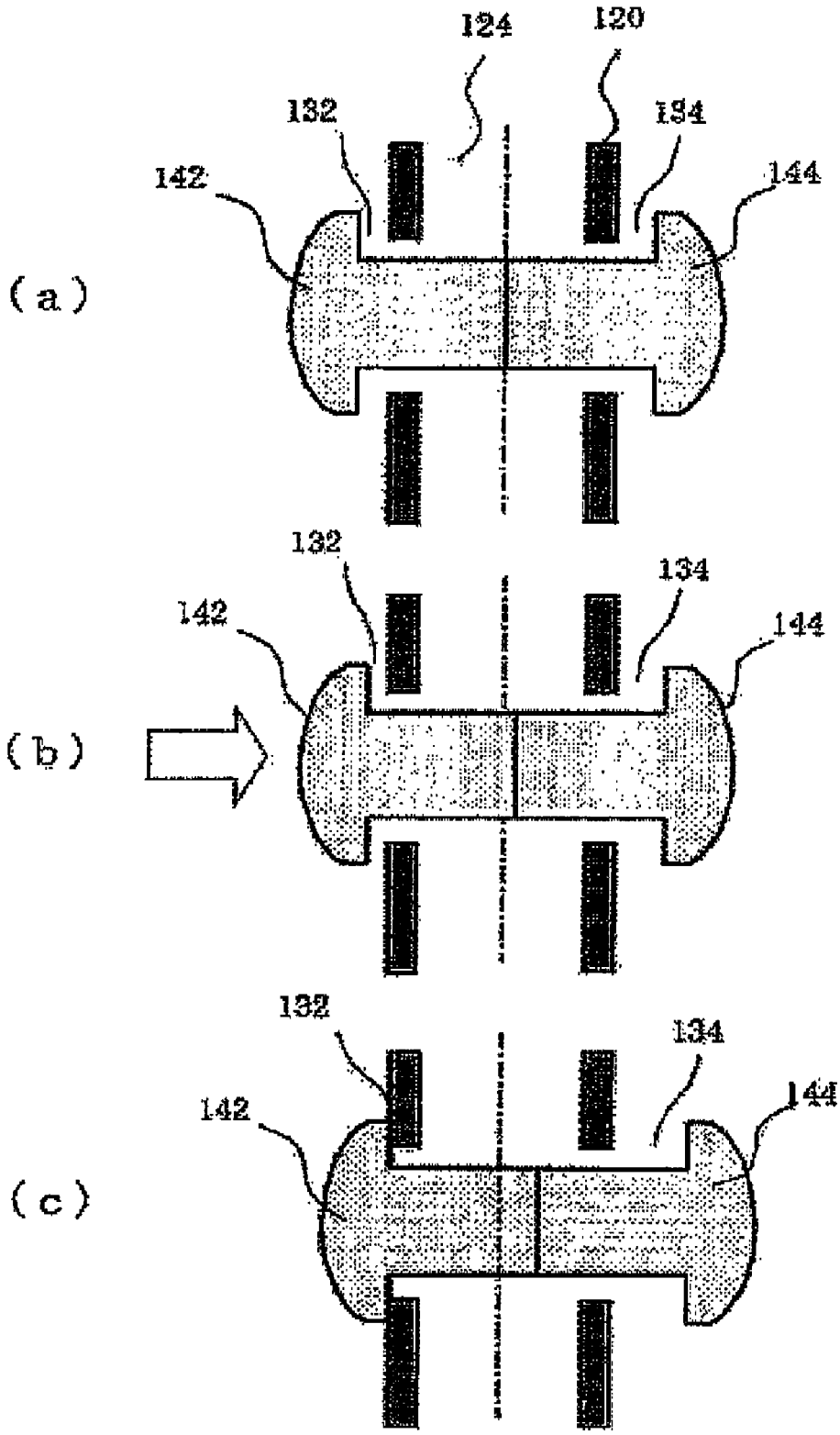
FIG. 5 is a schematic view for describing the function and effect of providing an opening difference between introducing ports 132, 134.

FIG. 5 is a schematic view for describing the function and effect of providing an opening difference between introducing ports 132, 134. As illustrated in FIG. 5(*a*), when valve bodies 142, 144 are in a neutral state and introducing ports 132, 134 have nearly the same opening, the channels through introducing ports 132, 134 also have nearly the same channel resistance and hence cause no pressure difference between the right and left side of core 120. Therefore core 120 does not move unless any external force acts thereon.

On the other hand, as illustrated in FIG. 5(*b*), when valve bodies 142, 144 deviate from the neutral state and an opening difference occurs between introducing port 132 and 134, a difference also occurs in channel resistance and causes a pressure difference between the right and left side of core 120.

Note that the "opening" of the introducing port used herein refers to a parameter determining the channel resistance for fluid flowing between the introducing port and the valve body. For example, in the state shown in FIG. 5(*b*), the channel resistance of the channel formed between introducing port 132 and valve body 142 is larger than the channel resistance of the channel formed between introducing port 134 and valve body 144. In this case, the opening of introducing port 132 is smaller than the opening of introducing port 134. In the example shown in FIG. 5(*b*), because the opening of introducing port 134 is larger than the opening of introducing port 132, the channel through introducing port 132 has a larger channel resistance. As a result, the pressure on the left side of core 120 is higher than that on the right side. Consequently, forces due to the pressure difference act on core 120 and valve body 142, respectively.

Therefore, when the force applied to core 120 exceeds the sliding resistance, core 120 moves to the right side. On the other hand, valve body 142 is also movable relative to core 120. Thus, when the force applied to valve body 142 exceeds the sliding resistance of valve body 142, valve body 142 moves to the right side relative to core 120. If valve body 142 moves to the right side, the channel through introducing port 132 has an even higher channel resistance, which expands the pressure difference. That is, the forces applied to core 120 and valve 142 are increased, respectively, and the movement of core 120 and valve body 142 is promoted. Ultimately, as shown in FIG. 5(*c*), introducing port 132 is fully closed. At this time, the left-right difference in channel resistance is maximized, and forces corresponding to the maximum pressure difference act on core 120 and valve body 142, respectively.

As described above, in driving unit 100 of the embodiment, core 120 can be moved simply by providing an opening difference between introducing ports 132, 134 to produce a pressure difference required for the movement. Then the pressure difference is maximized by causing one of the introducing ports to be in the open state and the other to be in the closed state. This achieves the most reliable and stable force for movement.

Returning again to FIG. 2, as shown in this figure, when core 120 moves in housing 102 to or near the right end of its moving stroke, valve bodies 142, 144 move to the left side by the control means. Then, introducing port 134 on the right side of core 120 is closed, and introducing port 132 on the left side is opened. In this state, the water supplied from water inlet port 112 flows from pressure chamber 116 via introducing port 132 into core inner channel 124 of core 120 as shown by arrow C, and flows out of water discharge tubular body 180 as shown by arrow D. On the other hand, because the water supplied from water inlet port 114 has no outflow path, the pressure in pressure chamber 118 becomes higher than the pressure in pressure chamber 116. As a result, core 120 moves to the left as shown by arrow M in FIGS. 5 and 1.

Figure 4:
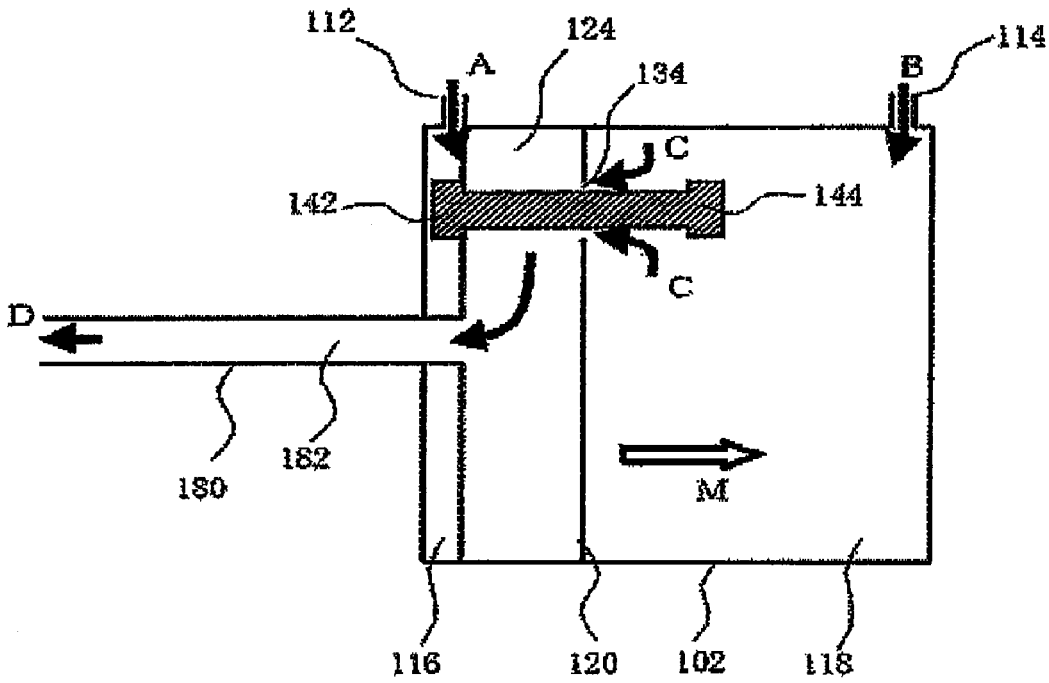
FIG. 4 is a schematic view for describing the mechanism of driving unit 100.

When core 120 continues to move to the left side and arrives at or near the left end of housing 102 as shown in FIG. 4, valve bodies 142, 144 move to the right side by the control means. Then, as described above with reference to FIG. 1, introducing port 132 on the left side of core 120 is closed, and introducing port 134 on the right side is opened. As a result, the pressure in pressure chamber 116 becomes higher than the pressure in pressure chamber 118, and core 120 moves to the right side as shown by arrow M. Subsequently, by repeating the action described above with reference to FIGS. 1 to 4, core 120 continues to reciprocate in housing 102.

Figure 6:
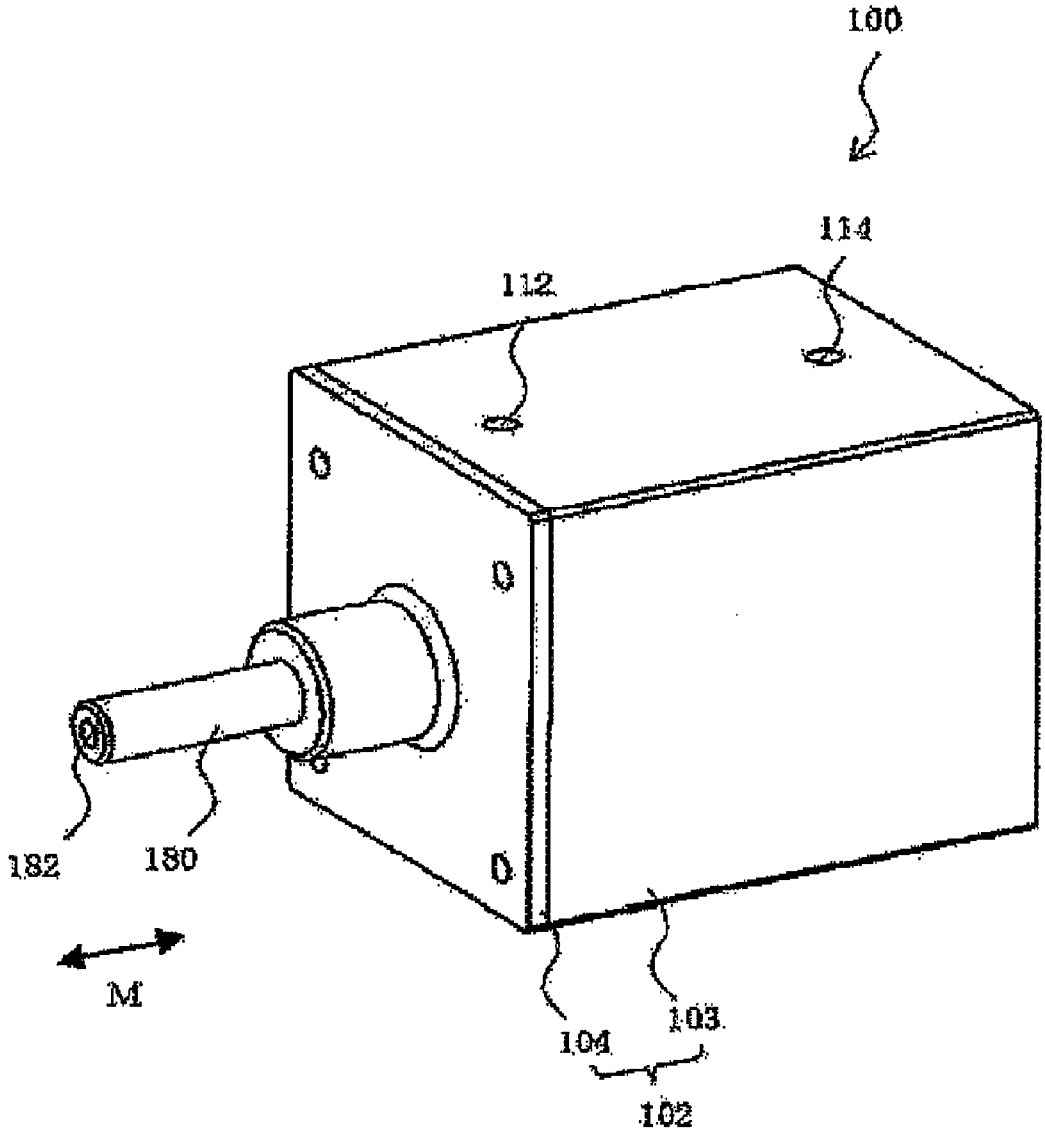
FIG. 6 is a perspective view of driving unit 100.
Figure 7:
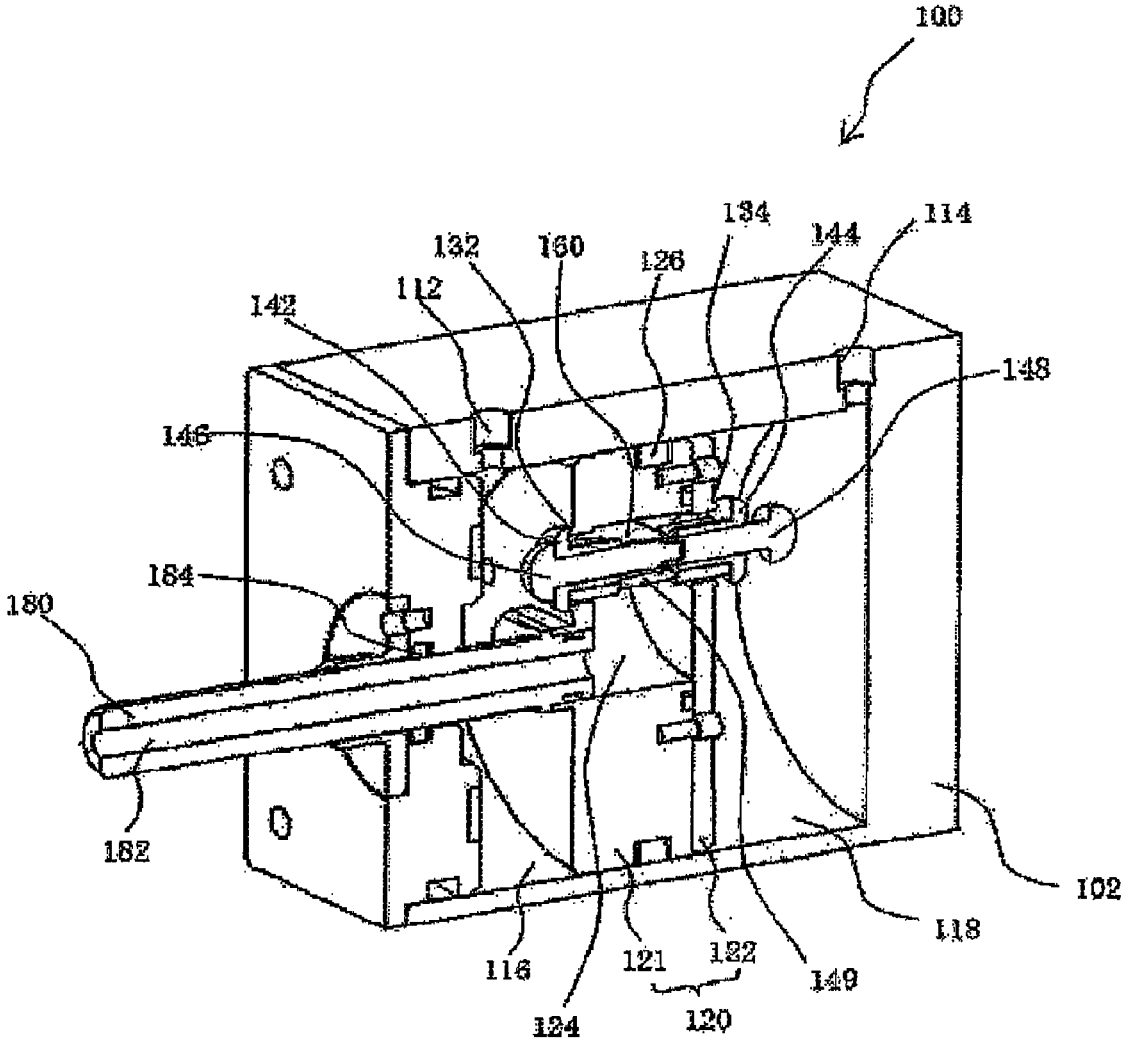
FIG. 7 is a perspective cutaway view of driving unit 100.
Figure 8:
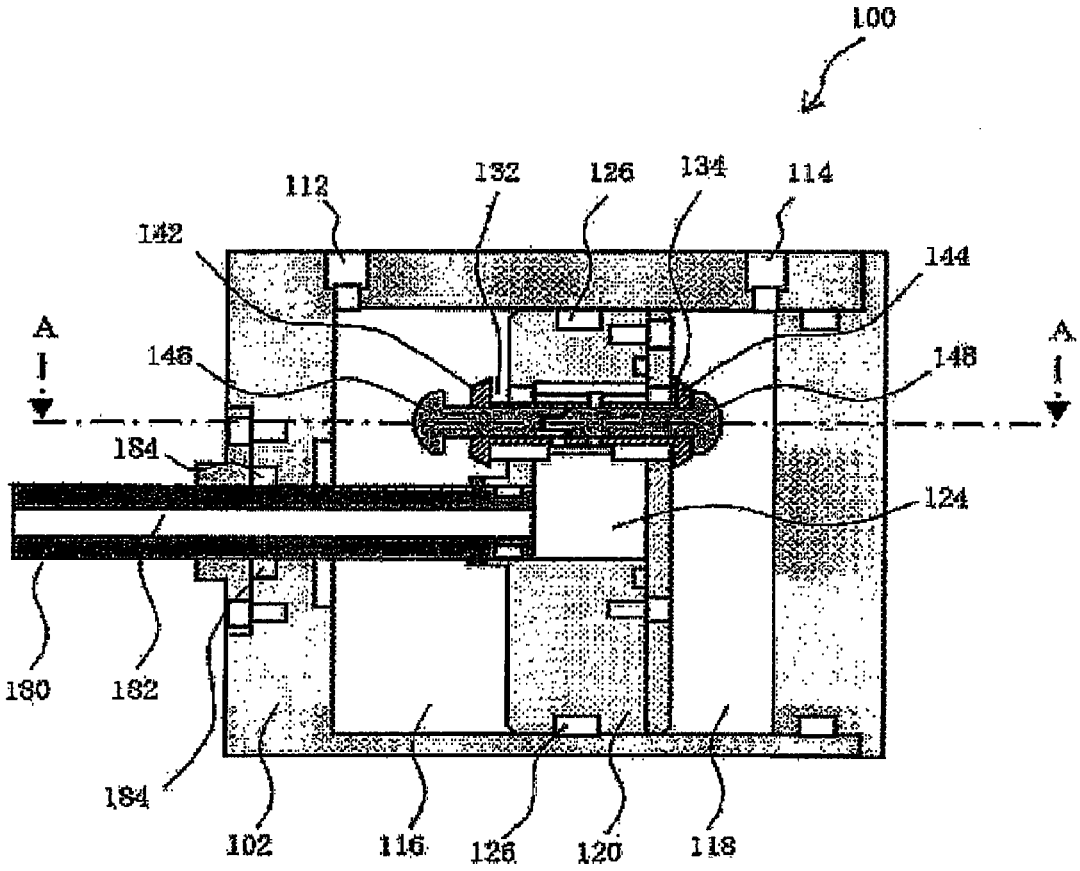
FIG. 8 is a cross section of driving unit 100.
Figure 9:
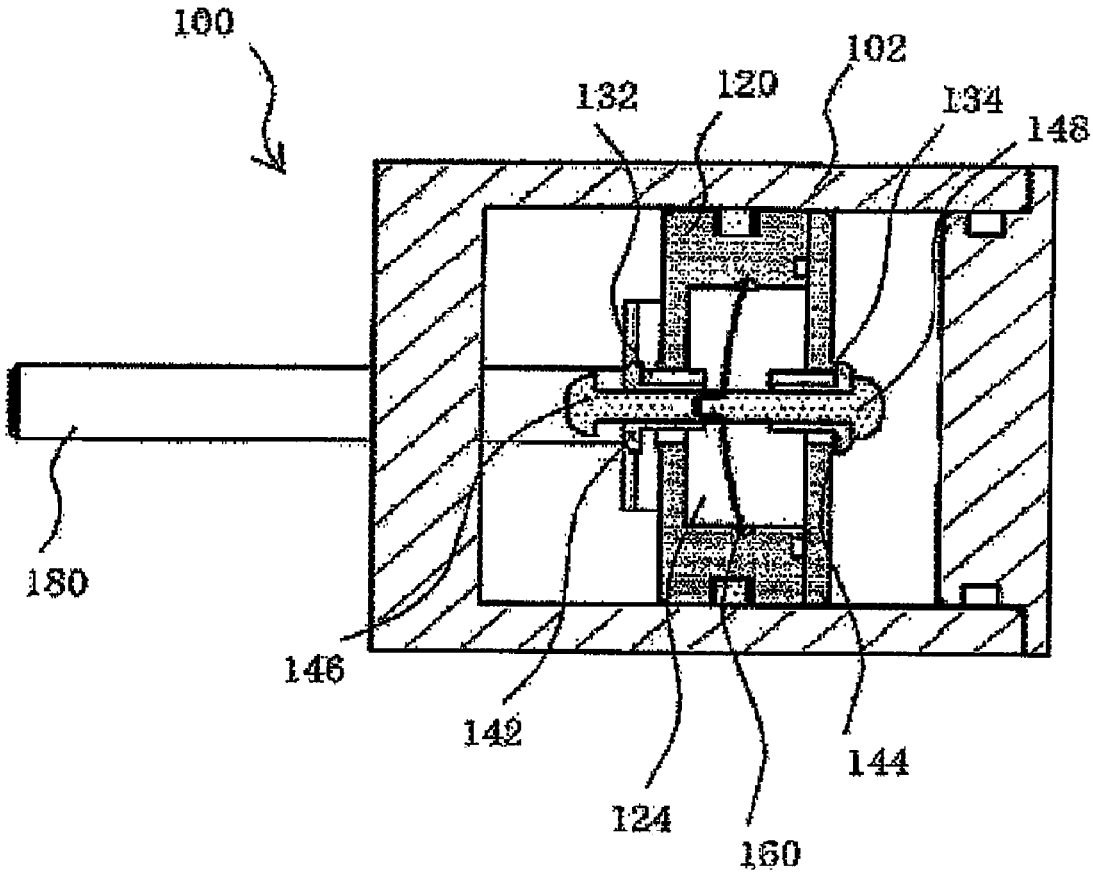
FIG. 9 is a cross section along line A-A in FIG. 8.

In the following, the structure of driving unit 100 of the embodiment will be described in more detail with reference to examples. FIG. 6 is a perspective view of driving unit 100 of the example, FIG. 7 is a perspective cutaway view thereof, FIG. 8 is a cross section, and FIG. 9 is a cross section along line A-A in FIG. 8. Driving unit 100 of the example has water discharge tubular body 180 that illustratively protrudes from housing 102 formed from housing main body 103 and housing lid 104. Water discharge tubular body 180 has a hollow structure having water discharge channel 182 inside and opened at the tip. Water discharge tubular body 180 does not necessarily need to be shaped as a circular cylinder, but various other examples may be contemplated including a rectangular cylinder and a flattened shape.

When water is introduced into water inlet ports 112, 114 provided in housing main body 103, water discharge tubular body 180 protruding on either side reciprocates linearly in the direction of arrow M.

The internal structure is described. As shown in FIGS. 7 to 9, a core 120 composed of core main body 121 and core lid 122 is movably contained in a tubular space inside housing 102 formed from housing main body 103 and housing lid 104. Core 120 is coupled to water discharge tubular body 180 protruding from the housing 102, and move like a piston, dividing the tubular space inside the housing 102 into first pressure chamber 116 and second pressure chamber 118. Water is introduced from water inlet ports 112, 114 into pressure chambers 116, 118, respectively. The sliding portion between core 120 and the inner wall of housing 102 is provided with seal 126 for facilitating sliding while maintaining liquid tightness. The sliding portion between tubular body 180 and housing 102 is also provided with seal 184 for the same purpose. Seals 126, 184 are for facilitating sliding while maintaining liquid tightness and can be made of such materials as Teflon®, NBR (nitrile rubber), EPDM (ethylene-propylene rubber), and POM (polyacetal). "Liquid tightness" used herein can be satisfied by ensuring the condition sufficient for producing a pressure difference between the right and left pressure chamber.

Next, the structure of the core 120 is described. Core inner channel 124 is formed by combining core lid 122 with core main body 121. Core inner channel 124 communicates with water discharge channel 182 provided in water discharge tubular body 180. Core main body 121 and core lid 122 have introducing ports 132, 134 allowing core inner channel 124 to communicate with pressure chambers 116, 118.

In the example, leaf spring 160 and slide bars 146, 148 are provided in core 120 as the control means. Slide bars 146, 148 are provided so as to traverse core inner channel 124 with main valves.

Figure 10:
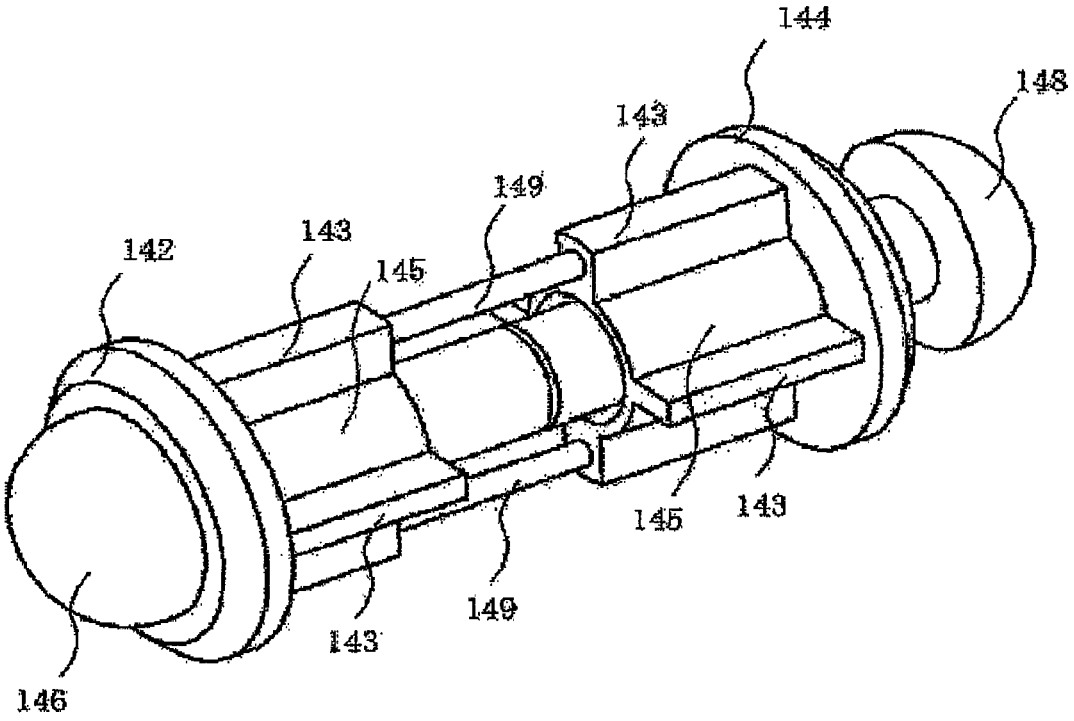
FIG. 10 is a perspective view showing the main valve and the slide bar.

FIG. 10 is a perspective view showing the main valves and the slide bars. The right and left main valves 142, 144 are coupled to each other by coupling rods 149, and provided through introducing ports 132, 134 provided in core main body 121 and core lid 122 so as to move from side to side. That is, main valves 142, 144 as valve bodies are provided so as to move from side to side relatively to core 120 with a prescribed stroke. Ribs 143 are formed on main valves 142, 144 so that main valves 142, 144 move coaxially with respect to introducing ports 132, 134. When main valves 142, 144 move away from core 120, respectively, groove portion 145 provided between ribs 143 becomes the opening portion of introducing ports 132, 134 and forms a channel for water. Furthermore, slide bars 146, 148 coaxially penetrating main valves 142, 144 are also provided so as to move from side to side. That is, slide bars 146, 148 are provided so as to move from side to side with a longer stroke than the action stroke of main valves 142, 144.

As illustrated in FIGS. 8 to 9, when main valve 146 is moved away from core 120, introducing port 132 is opened. Conversely, when main valve 144 is moved away from core 120, introducing port 134 is opened. Introducing ports 132, 134 both communicate with core inner channel 124. That is, introducing port 132 allows pressure chamber 116 in the housing to communicate with core inner channel 124, and introducing port 134 allows pressure chamber 118 to communicate with core inner channel 124.

The action of main valves 142, 144 to vary the opening of introducing ports 132, 134 is determined by the coaxially provided slide bars 146, 148. More specifically, as shown in FIG. 9, both sides of slide bar 146, 148 are coupled to each other across compressed leaf spring 160, and subjected to a biasing force toward the right end or the left end depending on the bend direction of leaf spring 160. Leaf spring 160 is supported at both ends by core 120. Slide bars 146, 148 move relatively to core 120 via leaf spring 160. Main valves 142, 144 are subjected to the biasing force from slide bars 146, 148 to place introducing ports 132, 134 to one of the fully open state and the fully closed state alternatively. That is, slide bars 146, 148 and leaf spring 160 act as a control means to control main valves 142, 144 as valve bodies.

Figure 11:
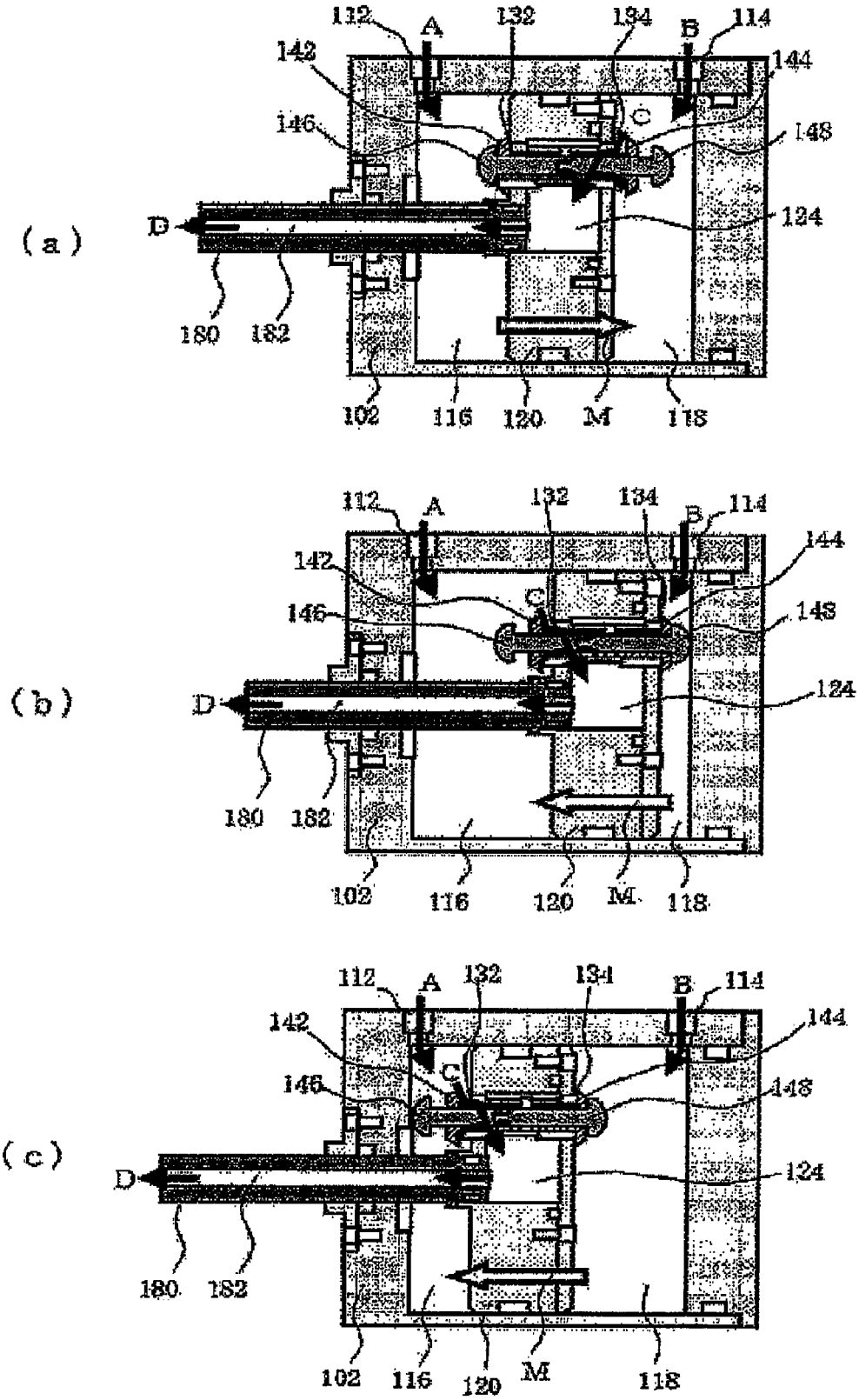
FIG. 11 is a schematic view showing the reciprocating action of driving unit 100.

In the following, the action of the driving unit of the example is described. FIG. 11 is a schematic view for describing the reciprocating action of the driving unit of the example. More specifically, FIG. 11(*a*) shows a state where slide bars 146, 148 are biased toward the right side under the action of leaf spring 160. At this time, because main valves 142, 144 are also biased toward the right side by slide bar 146, a state occurs where introducing port 132 is closed and introducing port 134 is opened.

In this state, when water is supplied to water inlet ports 112, 114 at nearly the same pressure, the water introduced from water inlet port 114 into pressure chamber 118 as shown by arrow B flows from introducing port 134 into core inner channel 124 as shown by arrow C and flows out as shown by arrow D via water discharge channel 182. On the other hand, because introducing port 132 is closed, the water introduced from water inlet port 112 into pressure chamber 116 as shown by arrow A has no outflow path and the pressure in pressure chamber 116 becomes higher than the pressure in pressure chamber 118. That is, by providing an opening difference between introducing ports 132, 134, a difference in channel resistance occurs, which causes a pressure difference. As a result, core 120 is pushed and moved in the direction of arrow M.

When core 120 moves in the direction of arrow M, the volume of pressure chamber 116 increases, and the volume of pressure chamber 118 decreases by that amount. Therefore the water in pressure chamber 118 is pushed out by the amount of water flowing into pressure chamber 116 via the path of arrow A, and is included in the discharge amount of water flowing out of channel 182.

As core 120 continues to move in the direction of arrow M from the state shown in FIG. 11(*a*), slide bar 148 abuts against the inner wall of housing 102 and is pushed against the core. Then the bend direction of leaf spring 160 is reversed, and slide bars 146, 148 are biased toward the left side as shown in FIG. 11(*b*). Then slide bar 148 pushes main valve 144, and thereby main valves 142, 144 are also moved to the left side. That is, introducing port 132 is opened, and introducing port 134 is closed. In the state shown in FIG. 11(*b*), the water introduced from water inlet port 112 into pressure chamber 116 as shown by arrow A flows through introducing port 132 into core inner channel 124 as shown by arrow C and flows out via water discharge channel 182, as shown by arrow D. On the other hand, because introducing port 134 is closed, the water introduced from water inlet port 114 into pressure chamber 118 as shown by arrow B has no outflow path and the pressure in pressure chamber 118 becomes higher than the pressure in pressure chamber 116. As a result, a pressure difference occurs between pressure chambers 116 and 118, and core 120 begins to move toward the left side as shown by arrow M.

As shown in FIG. 11(*c*), core 120 continues to move to the position where slide bar 146 abuts against the inner wall of housing 102. From this state, core 120 moves further, and slide bar 146 is pushed against core 120 to reverse the bend direction of leaf spring 160, which is thus biased to the right side. Then, like the state shown in FIG. 11(*a*), introducing port 132 is closed, introducing port 134 is opened, and core 120 begins to move toward the right side.

As described above, according to the example, because core 120 is provided with main valves 142, 144 as valve bodies and with a control means composed of slide bars 146, 148 and leaf spring 160, the size relation of the opening difference between introducing ports 132 and 134 can be appropriately inverted depending on the movement of core 120. Thus core 120 is able to reciprocate. The stroke of reciprocation of core 120 of the example can be configured appropriately on the basis of the length of the interior space of housing 102 and the thickness (width) of core 120.

Figure 12:
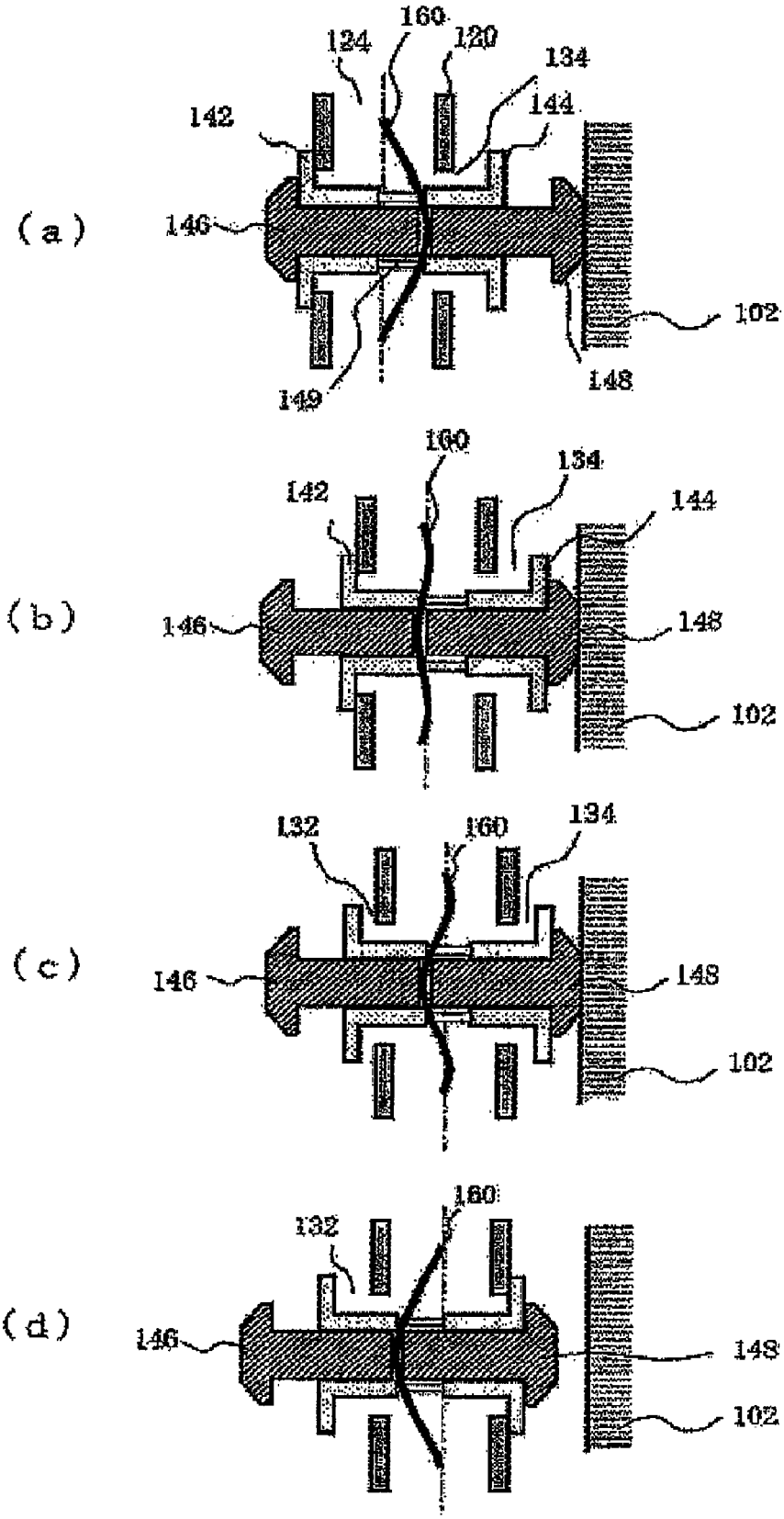
FIG. 12 is a schematic view for describing the operation of the control means.

Next, the function of the control means in the example is described in more detail. FIG. 12 is a schematic view for describing the operation of the control means in this embodiment. More specifically, FIG. 12(*a*) shows the state where leaf spring 160 is bent to the right side to bias slide bars 146, 148 in this direction. At this time, introducing port 132 is closed by main valve 142, and introducing port 134 is opened by main valve 144. In this state, as core 120 moves to the right side, slide bar 148 abuts against the inner wall of housing 102 as shown in this figure (a). Because a pressure difference is acting on core 120, core 120 moves further to the right with slide bar 148 abutting against the housing inner wall, and results in the state shown in FIG. 12(*b*). That is, the relative position of core 120 and slide bar 148 is varied against the biasing force of leaf spring 160, and slide bar 148 is pushed against the core. As a result, leaf spring 160 is also pushed to the left side and deformed to take a generally S-shaped configuration as illustrated in this figure. At this time, main valves 142, 144 are subjected to the pressure difference like core 120 and do not change the open/closed state of introducing ports 132, 134.

Subsequently, core 120 moves further, and thereby slide bar 148 is further pushed against core 120. Then, as shown in FIG. 12(*c*), leaf spring 160 begins to reverse its bend direction to the left side and biases slide bars 146, 148 to the left side.

Then, as shown in FIG. 12(*d*), main valves 142, 144 are moved to the left side by the biasing force of leaf spring 160. Thus introducing port 132 is fully opened, and introducing port 134 is fully closed.

As described above, in the example, the bend direction of compressed leaf spring 160 is appropriately reversed by slide bars 146, 148, and its biasing force is used to operate main valves 142, 144, thereby alternatively controlling introducing ports 132, 134 to be in one of the fully open state and the fully closed state. That is, the biasing force of leaf spring 160 is used to reliably produce the opening difference between both of introducing port 132, 134 for reversing core 120.

The mechanism of this example for controlling main valves 142, 144 via slide bars 146, 148 plays a very important role in the smooth action of the water discharger of this embodiment. More specifically, compressed leaf spring 160, which is stable in the state bent to the right side or the left side, may fall into a metastable state, neutral state about halfway between these stable states as shown in FIG. 12(*b*). That is, in this state, a sufficient biasing force to the left or right does not occur in leaf spring 160. Therefore, in this state, if introducing ports 132, 134 happen to have nearly the same opening, water flows in through introducing ports 132, 134 on both sides of the core. Thus the pressure difference vanishes, and core 120 stops moving. That is, if the timing at which main valves 142, 144 begin to move is earlier than the timing of the reversal of leaf spring 160, core 120 may stop moving.

In contrast, according to this example, slide bars 146, 148 are provided, and their stroke is appropriately adjusted. Thus, in the metastable neutral state as shown in FIG. 12(*b*), a state can be maintained where main valves 142, 144 do not yet move while core 120 continues to move under pressure. Main valves 142, 144 are allowed to begin to move only when leaf spring 160 traverses this neutral state and begins to be reversed. That is, the timing at which main valves 142, 144 begin to move can be synchronized with the timing of the reversal of leaf spring 160.

In other words, before the opening difference enough to move core 120 is lost, leaf spring 160 is reversed, and main valves 142, 144 are moved by the reversing force (biasing force) via slide bars 146, 148. Thus the opening difference between introducing ports 132, 134 can be inverted to the opening difference enough to move core 120 in the opposite direction.

This eliminates the problem that introducing ports 132, 134 may have nearly the same opening which results in stopping core 120 when leaf spring 160 is in the neutral state. Thus a smooth repetitive motion can be achieved.

Furthermore, in this configuration, even when shower water sprinkle is started from the state where core 120 is stopped about halfway through its moving stroke, main valves 142, 144 can be controlled by leaf spring 160 at the beginning of shower water sprinkle to be in the state where one of introducing ports 132, 134 is alternatively opened. Thus a pressure difference is produced between both sides of core 120, and a stable initial action can be started. That is, the state where the opening of introducing port 134 is larger than the opening of introducing port 132, or the state where the opening of introducing port 132 is larger than the opening of introducing port 134, can be retained alternatively.

As described above, in the example, the moving direction of core 120, the movable direction of main valves 142, 144, the movable direction of slide bars 146, 148, and the biasing direction of leaf spring 160 can be made generally the same to avoid waste in the action of force and to effectively use the moving force of the core having a large pressure-receiving area. Thus a smooth and stable action is achieved. That is, the moving action and the opening control action of core 120 are interlocked, and thereby the control action to invert the size relation of the opening of introducing ports 132, 134 for the reversal of core 120 is made reliable and easy. Thus the valve bodies and the control means are made simple and compact.

In the example shown in FIGS. 6 to 12, while slide bar 146, 148 abuts against the inner wall of housing 102 when core 120 is reversed, the invention is not limited thereto. For example, slide bars 146, 148 can be provided with a magnet, the inner wall of housing 102 can also be provided with a magnet, and the repulsive force acting therebetween can be used to stop slide bars 146, 148 relative to housing 102. That is, in this case, in the state corresponding to FIGS. 12(*a*) to 12(*c*), slide bar 146, 148 does not abut against the inner wall of housing 102, but is located at a prescribed distance apart from the inner wall of housing 102 by the repulsive force of the magnets (not shown). Thus core 120 can be reversed in a noncontact manner.

Furthermore, the thrust obtained in the reciprocating linear action of driving unit 100 of this embodiment is determined by the product of the pressure of water loaded on core 120 and the pressure-receiving area of the core. Therefore, as the pressure-receiving area of core 120 is increased, a correspondingly larger thrust can be obtained.

While FIGS. 7 to 9 show an example where circular core 120 is contained in a generally cylindrical space provided in the housing, the invention is not limited thereto. For example, the interior space of housing 102 may be shaped as a rectangular cylinder or a flattened cylinder, and core 120 may have any of various shapes correspondingly.

The outer peripheral shape of water discharge tubular body 180 does not need to be circular, but may be in a polygonal or flattened shape. Furthermore, water discharge tubular body 180 does not need to be placed at the center of core 120, but may be decentered from the center of core 120. This facilitates downsizing core 120, and driving unit 100 can be downsized.

When the interior space of housing 102 is configured as a cylinder and water discharge tubular body 180 is placed at the center of cylindrical core 120 as in this example, water discharge tubular body 180 can be rotated. Thus, the reciprocating linear motion of core 120 allows the shower water sprinkle direction to change as well.

As described above, core 120 can be moved simply by providing an opening difference between the introducing port 132 and 134 to produce a pressure difference required for the movement. Likewise, the moving direction of core 120 can be reversed simply by inverting the size relation of the opening of introducing ports 132, 134 using the control means. For example, the ratio of opening between introducing ports 132, 134 can be changed from 70:30 to 30:70 by the control means to achieve the reversal action. Furthermore, when the opening is changed from 100:0 to 0:100 by the control means, the most reliable and stable reversal action is achieved.

According to driving unit 100 of the embodiment, the core contained in housing 102 is provided with valve bodies 142, 144 and the control means. Core 120 can be reciprocated by supplying water into the pressure chambers on both sides thereof. Here, the moving direction of core 120 is made generally the same as the movable direction of valve bodies 142, 144 to interlock the moving action and the opening control action of core 120. Thus the reversal action of the valve bodies to invert the size relation of the opening of introducing ports 132, 134 for the reversal of core 120 is made reliable and easy, and the valve bodies and the control means are made simple and compact.

As described later in detail, water discharge channel 182 inside water discharge tubular body 180 of the embodiment plays a role as a water guide channel introducing water flowed in from core 120 into the shower part. Moreover, for example, as described later with respect to FIG. 39 to FIG. 41, the reciprocating linear motion of core 120 can achieve the swinging motion of shower part 410 via mechanism 458 (power transmission part) converting the linear motion to the swinging motion.

Figure 13:
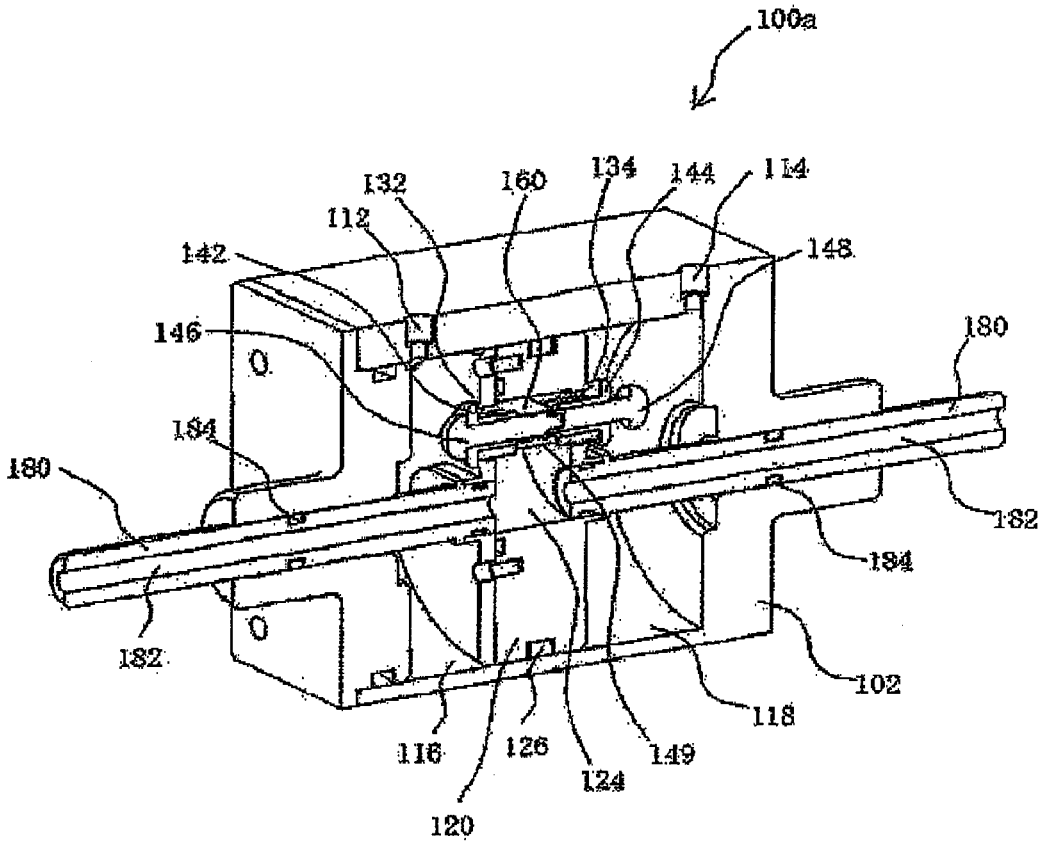
FIG. 13 is a schematic cross section showing a variation of driving unit 100.

FIG. 13 is a schematic cross section showing a variation of driving unit 100. With regard to this figure, elements similar to those described above with reference to FIG. 6 to FIG. 9 are marked with the same reference numerals and not described in detail.

Driving unit 100*a* is provided with water discharge tubular body 180 on both sides of core 120. That is, water discharge tubular body 180 protrudes from both sides of housing 102 and is particularly useful when sprinkling water from both sides is desired. In such a case, water discharge channel 182 inside water discharge tubular body 180 of the embodiment plays a role as a water guide channel introducing water flowed in from core 120 into the shower part. Furthermore, as described later with respect to FIG. 21, the reciprocating linear motion of core 120 achieve the swinging motion M2 of shower parts 71*a*, 71*b* via mechanism (power transmission part) converting the linear motion to the swinging motion.

In the first embodiment of the driving unit described above, the unit in which the core reciprocates linearly was described. Next, a second embodiment of the driving unit in which the core oscillates will be described.

Figure 14:
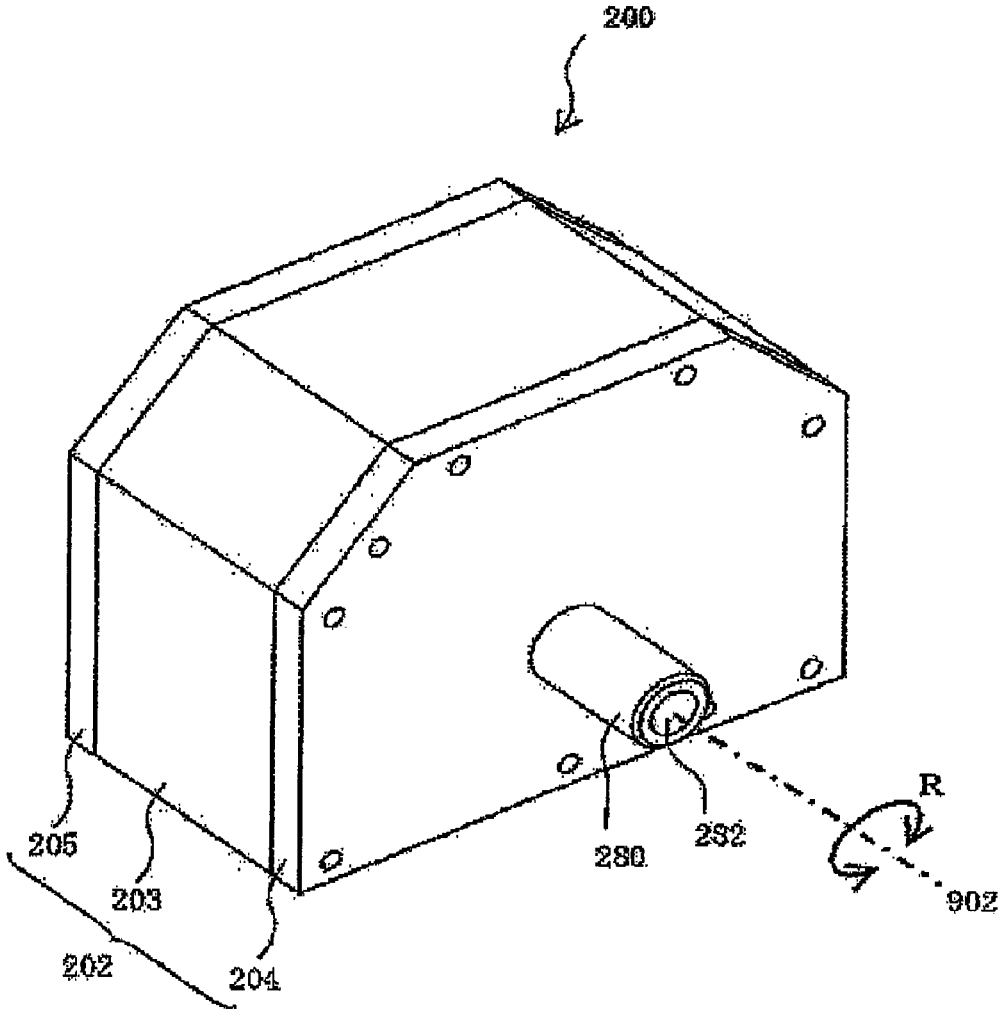
FIG. 14 is a perspective view of driving unit 200.
Figure 15:
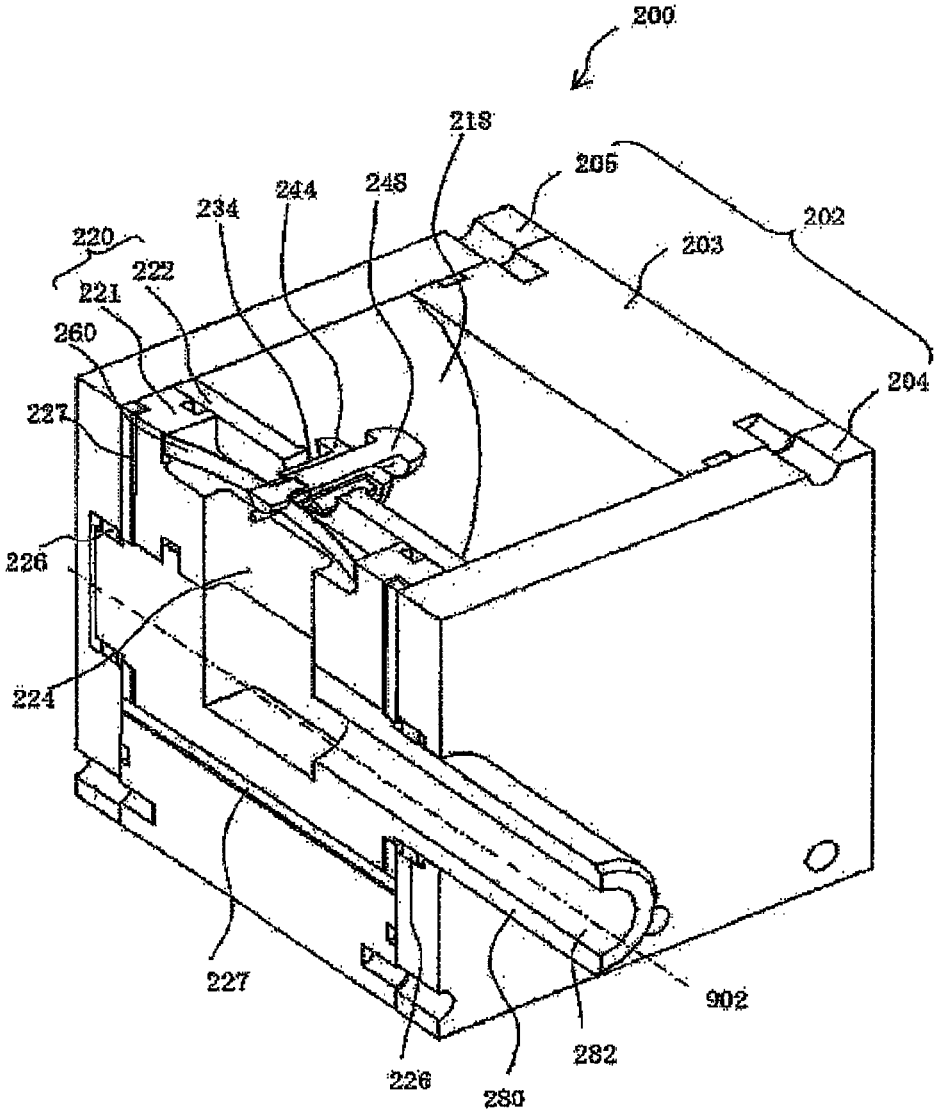
FIG. 15 is a perspective cutaway view of driving unit 200.
Figure 16:
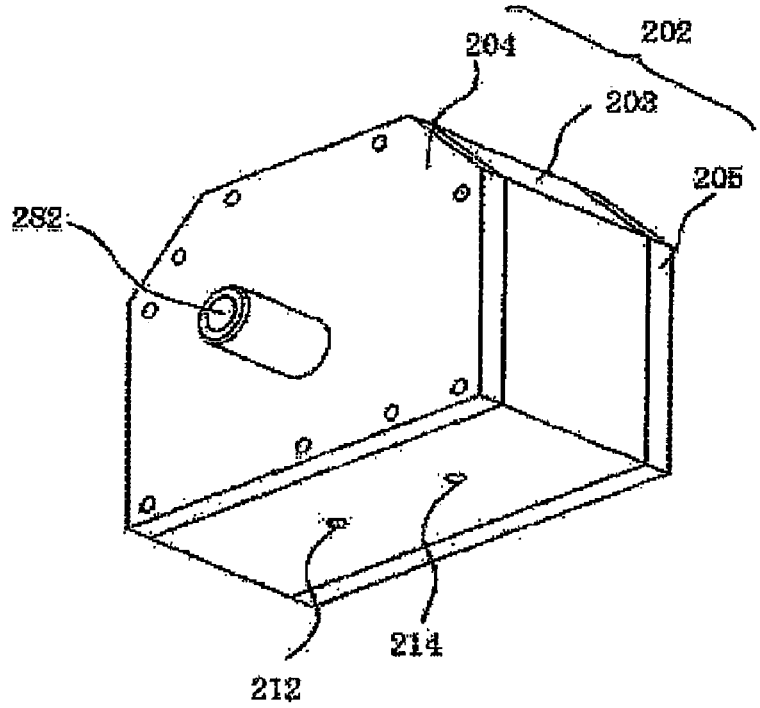
FIG. 16 is a perspective view and a cutaway view of driving unit 200 as viewed from the bottom side.
Figure 16:
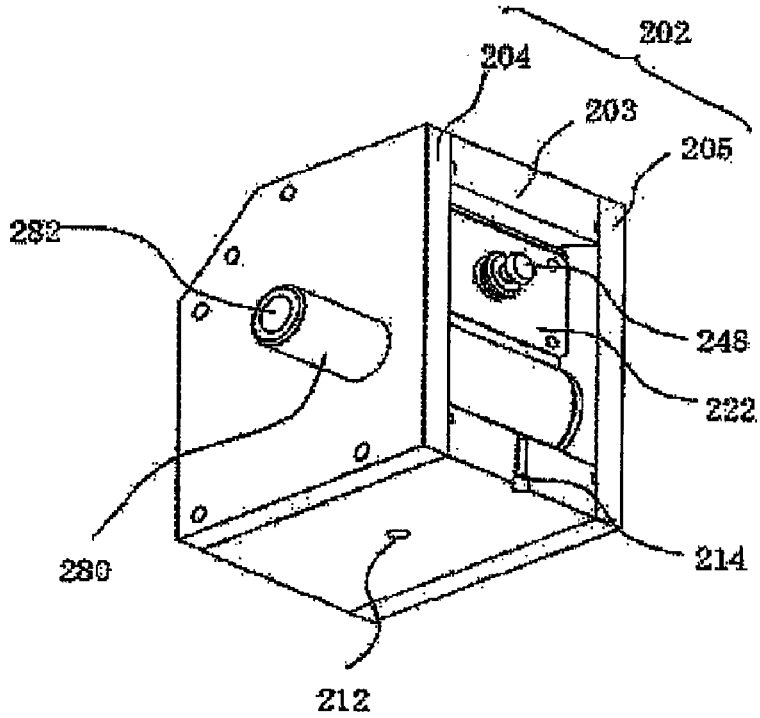
Figure 17:
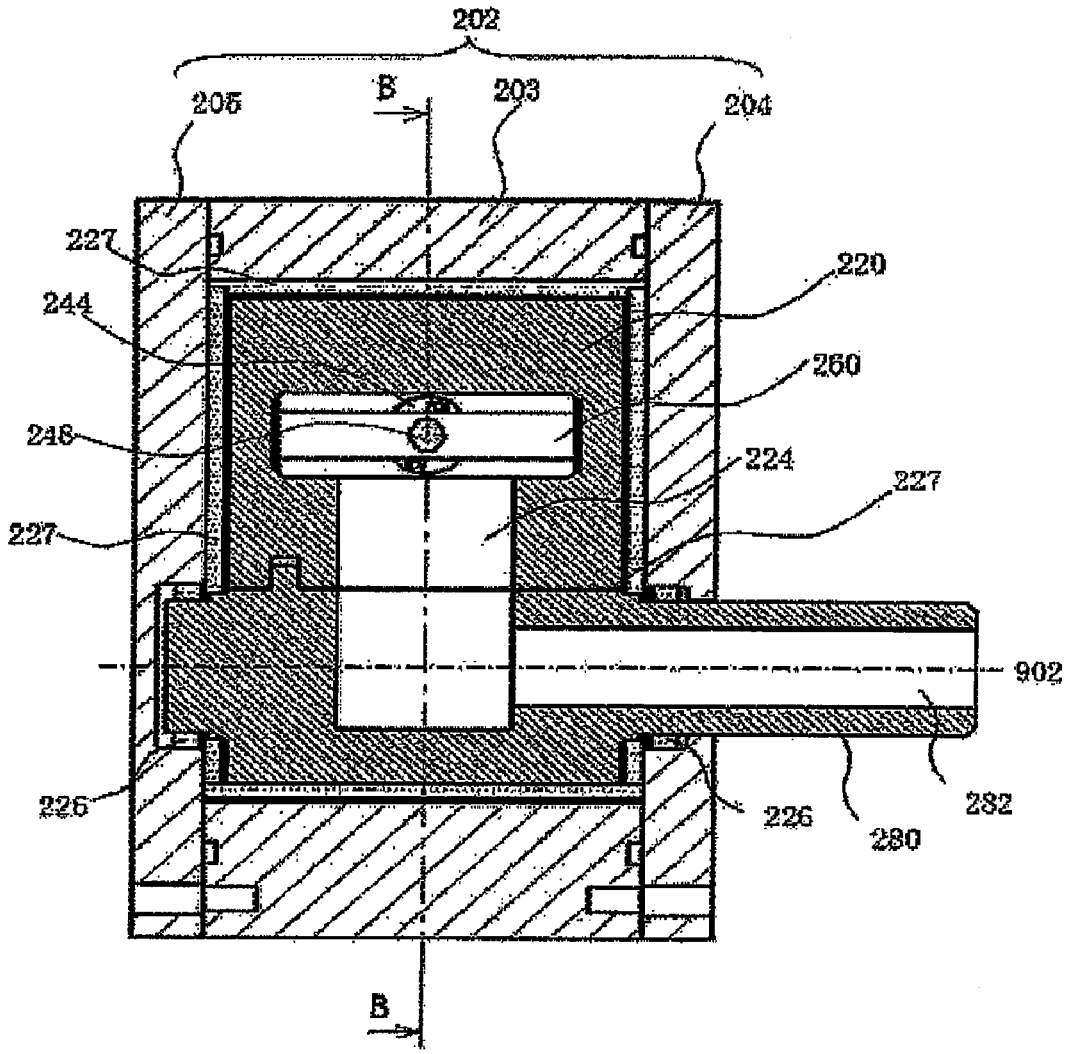
FIG. 17 is a vertical cross section of driving unit 200.
Figure 18:
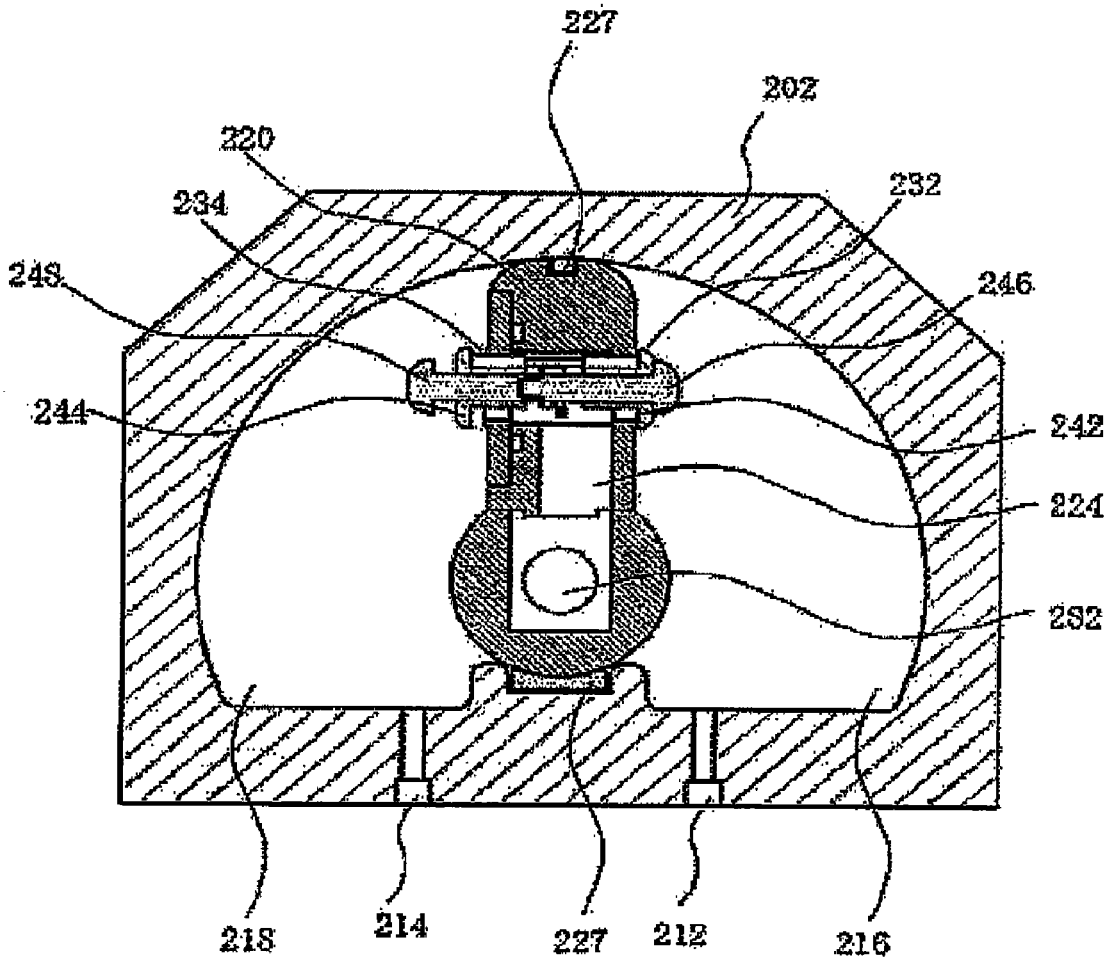
FIG. 18 is a cross section along line B-B in FIG. 17.

FIGS. 14 to 18 are schematic views showing the relevant part of driving unit 200 of the embodiment. More specifically, FIG. 14 is a perspective view of driving unit 200 of the embodiment, FIG. 15 is a perspective cutaway view thereof, FIG. 16 shows a perspective view and a cutaway view as viewed from the bottom side, FIG. 17 is a vertical cross section, and FIG. 18 is a cross section along line B-B in FIG. 17.

Driving unit 200 of this embodiment has water discharge tubular body 280 that illustratively protrudes on one side from housing 202 formed from housing main body 203 and housing lids 204, 205. Water discharge tubular body 280 has a hollow structure having water discharge channel 282 inside and opened at the tip. When water is introduced into water inlet ports 212, 214 provided in housing 202, water discharge tubular body 280 oscillates in the direction of arrow R.

The internal structure is described. As shown in FIGS. 15 to 18, core 220 composed of core main body 221 and core lid 222 is contained in a fan-shaped housing space formed from housing main body 203 and housing lids 204, 205, where the core is able to oscillate about core oscillating axis 902. Core 220 is coupled to water discharge tubular body 280 penetrating in housing lid 204, and oscillates, dividing the interior of the fan-shaped housing into first pressure chamber 216 and second pressure chamber 218. Water is introduced from water inlet ports 212, 214 into pressure chambers 216, 218, respectively. The sliding portion between core 220 and the inner wall of housing 202 is provided with seal 227 for facilitating sliding while maintaining liquid tightness. The sliding portion between water discharge tubular body 280 and housing 202 is also provided with seal 226 for the same purpose. Seals 227, 226 are for facilitating sliding while maintaining liquid tightness and can again be made of such materials as Teflon®, NBR (nitrile rubber), EPDM (ethylene-propylene rubber), and POM (polyacetal). "Liquid tightness" used herein can be satisfied by ensuring the condition sufficient for producing a pressure difference between the right and left pressure chamber.

Next, the structure of core 220 is described. In this embodiment again, core 220 has a valve body and a control means similar to driving unit 100 described above. Core inner channel 224 is formed in core 220. Core inner channel 224 communicates with water discharge channel 282 provided in water discharge tubular body 280. Core 220 has introducing ports (drain hole) 232, 234 allowing core inner channel 224 to communicate with pressure chambers 216, 218. Main valves 242, 244, slide bars 246, 248 are provided so as to traverse core inner channel 224. The shape of the main valve and the slide bar is as described above with reference to FIG. 10. The operation of the valve body and the control means composed of these elements is also similar to that described above with reference to driving unit 100.

That is, leaf spring 260 is supported at both ends by core 220. Slide bars 246, 248 move relatively to core 220 via leaf spring 260. The action of main valves 242, 244 to vary the opening of introducing ports 232, 234 is determined by the coaxially provided slide bars 246, 248. Slide bar 246, 248 are subjected to a biasing force depending on the bend direction of leaf spring 260. As a result, main valves 242, 244 are subjected to the biasing force from slide bars 246, 248 to place introducing ports 232, 234 in one of the state of the fully open state and the fully closed state alternatively.

Figure 19:
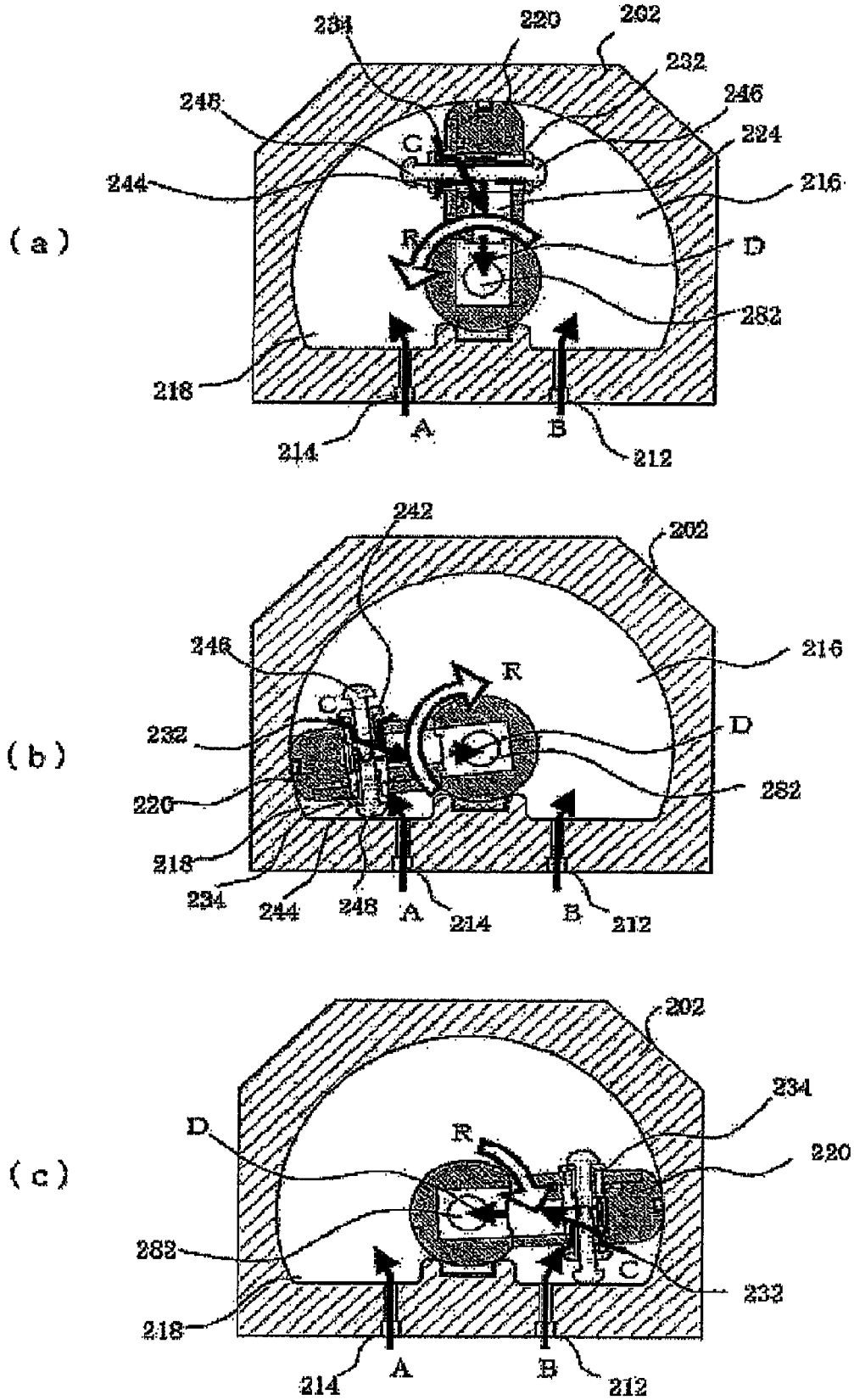
FIG. 19 is a schematic view describing the action of the driving unit.

In the following, the action of driving unit 200 is described. FIG. 19 is a schematic view for describing the action of driving unit 200.

First, FIG. 19(*a*) shows a state where slide bars 246, 248 are biased toward the left side under the action of leaf spring 260. At this time, because main valves 242, 244 are also biased toward the left side by slide bar 246, a state occurs where introducing port 232 is closed and introducing port 234 is opened.

In this state, when water is supplied to water inlet ports 212, 214 at nearly the same pressure, the water introduced from water inlet port 214 into pressure chamber 218 as shown by arrow A flows from introducing port 234 into core inner channel 224 as shown by arrow C and flows out as shown by arrow D via water discharge channel 282. On the other hand, because introducing port 232 is closed, the water introduced from water inlet port 212 into pressure chamber 216 as shown by arrow B has no outflow path and the pressure in pressure chamber 216 becomes higher than the pressure in pressure chamber 218. That is, by providing an opening difference between introducing ports 232, 234, a difference in channel resistance occurs, which causes a pressure difference. As a result, core 220 is pushed and oscillates in the direction of arrow R.

When core 220 oscillates in the direction of arrow R, the volume of pressure chamber 216 increases, and the volume of pressure chamber 218 decreases by that amount. Therefore the water in pressure chamber 218 is pushed out by the amount of water flowing into pressure chamber 216 via the path of arrow B, and is included in the discharge amount of water flowing out of channel 282.

Core 220 further continues to oscillate and slide bar 248 abuts against the inner wall of housing 202 and is pushed against core 220. Then the bend direction of leaf spring 260 is reversed, and slide bars 246, 248 are biased toward the opposite side as shown in FIG. 19(*b*). Then slide bar 248 pushes main valve 244, and thereby main valves 242, 244 are also moved to the right side (in the clockwise direction in FIG. 19). That is, introducing port 232 is opened, and introducing port 234 is closed. In the state shown in FIG. 19(*b*), the water introduced from water inlet port 212 into pressure chamber 216 as shown by arrow B flows through introducing port 232 into core inner channel 224 as shown by arrow C and flows out via water discharge channel 282 as shown by arrow D. On the other hand, because introducing port 234 is closed, the water introduced from water inlet port 214 into pressure chamber 218 as shown by arrow A has no outflow path and the pressure in pressure chamber 218 becomes higher than the pressure in pressure chamber 216. As a result, a pressure difference occurs between pressure chambers 216 and 218, and core 220 begins to oscillate toward the right side as shown by arrow R.

As shown in FIG. 19(*c*), core 220 further oscillates to the position where slide bar 246 abuts against the inner wall of housing 202. From this state, core 220 moves further, and slide bar 246 is pushed against core 220 to reverse the bend direction of leaf spring 260, which is thus biased to the opposite side. Then, like the state shown in FIG. 19(*a*), introducing port 232 is closed, introducing port 234 is opened, and core 220 begins to oscillate toward the left side.

As described above, in driving unit 200 again, core 220 is provided with the valve bodies composed of main valves 242, 244, and the control means composed of leaf spring 260 and slide bars 246, 248. Thus the size relation of the opening between the introducing ports can be appropriately inverted depending on the movement of core 220 to move core 220 right and left repetitively. In addition, in driving unit 200 again, as described above with reference to FIG. 12, the timing at which main valves 242, 244 begin reversal action can be synchronized with the timing of the reversal of leaf spring 260. This eliminates the problem that main valves 242, 244 may have nearly the same opening which results in stopping core 220 when leaf spring 260 is in the neutral state. Thus a smooth repetitive motion can be achieved.

In other words, before the opening difference enough to move core 220 is lost, leaf spring 260 is reversed, and main valves 242, 244 are moved by the reversing force (biasing force) via slide bars 246, 248. Thus the opening difference between introducing ports 232, 234 can be reversed to the opening difference enough to move core 220 in the opposite direction.

In driving unit 200 again, the oscillating direction of core 220, the movable direction of main valves 242, 244, the movable direction of slide bars 246, 248, and the biasing direction of leaf spring 260 can be made generally the same to avoid waste in the action of force and to effectively use the moving force of the core having a large pressure-receiving area. Thus a smooth and stable action is achieved. That is, when core 220 approaches the inner wall of housing 202, the moving direction of core 220 is made generally the same as the movable direction of main valves 242, 244, the biasing direction of leaf spring 260, and the movable direction of slide bars 246, 248. Thus the oscillating action and the opening control action of core 220 are interlocked, and the action of inverting the size relation of the opening of introducing ports 232, 234 for the reversal of core 220 is made reliable and easy. Thus the valve bodies and the control means are made simple and compact.

Furthermore, in this configuration, even when shower water sprinkle is started from the state where core 220 is stopped about halfway through its oscillating stroke, main valves 242, 244 can be controlled by leaf spring 260 at the beginning of shower water sprinkle to be in the state where one of introducing ports 232, 234 is opened alternatively. Thus a pressure difference is produced between both sides of core 220, and a stable initial action can be started. That is, the state where the opening of introducing port 234 is larger than the opening of introducing port 232, or the state where the opening of introducing port 232 is larger than the opening of introducing port 234, can be retained alternatively.

The stroke (oscillating angle) of the oscillating motion of core 220 in driving unit 200 can be appropriately configured by the opening angle of the fan-shaped space of housing 202.

Furthermore, in this embodiment again, the thrust obtained by the oscillating action is determined by the product of the pressure of water applied to core 220 and the pressure-receiving area of the core. Therefore, as the pressure-receiving area of core 220 is increased, a correspondingly larger thrust can be obtained.

In this embodiment again, water discharge channel 282 inside water discharge tubular body 280 plays a role as a water guide channel introducing water flowed in from core 120 into the shower part. Furthermore, as described later with respect to FIGS. 29 to 31, the swinging motion of shower part 410 is achieved by transmitting the oscillating motion of core 220 to shower part 410 via power transmission part.

Application of driving unit 100 and driving unit 200 described above allows the shower device of this invention to be capable of smooth reciprocating linear motion and oscillating motion of the core only by the supplied pressure of water without the necessity of electrical or mechanical motive energy. Furthermore, the shower device without waste water is realized by sprinkle the water in swinging state of the shower part.

Furthermore, in the shower device of the invention, the valve bodies and the control means allowing a reciprocating motion accompany the core. Therefore the need for an external four-way valve, for example is eliminated, and a smooth reciprocating motion can be achieved by a simple configuration. This facilitates downsizing of a whole device, and the beauty and the layout of bathroom space are advantageous.

It is configured that the shower part is coupled to water discharge tubular body reciprocating and water is discharged from the interior of the water discharge tubular body. Therefore, advantageously, the flow channel is simplified, the pressure loss can be reduced, and a sufficient amount and pressure of water discharge can be ensured.

Furthermore, because of the structure of incorporating the valve bodies and the control means in housing, smooth action resistant to external disturbances can be achieved while an assembly process can be simplified. As a result, highly reliable and stable operation of shower water sprinkle can be achieved.

Moreover, water supply to the driving unit can be implemented simply by coupling the lines branched from a common water tubular channel to two water inlet ports, achieving good workability. In addition, with respect to water inlet ports, water inlet ports corresponding to left and right pressure chambers may be simply formed, respectively. For example, divided channels are formed in the housing, coupled to each water inlet port, and water inlet coupling port to the housing is unified to be one, thereby, piping can be also further simplified.

Next, a method to stop the swinging motion of the shower part for improving convenience during taking a shower is described.

Figure 20:
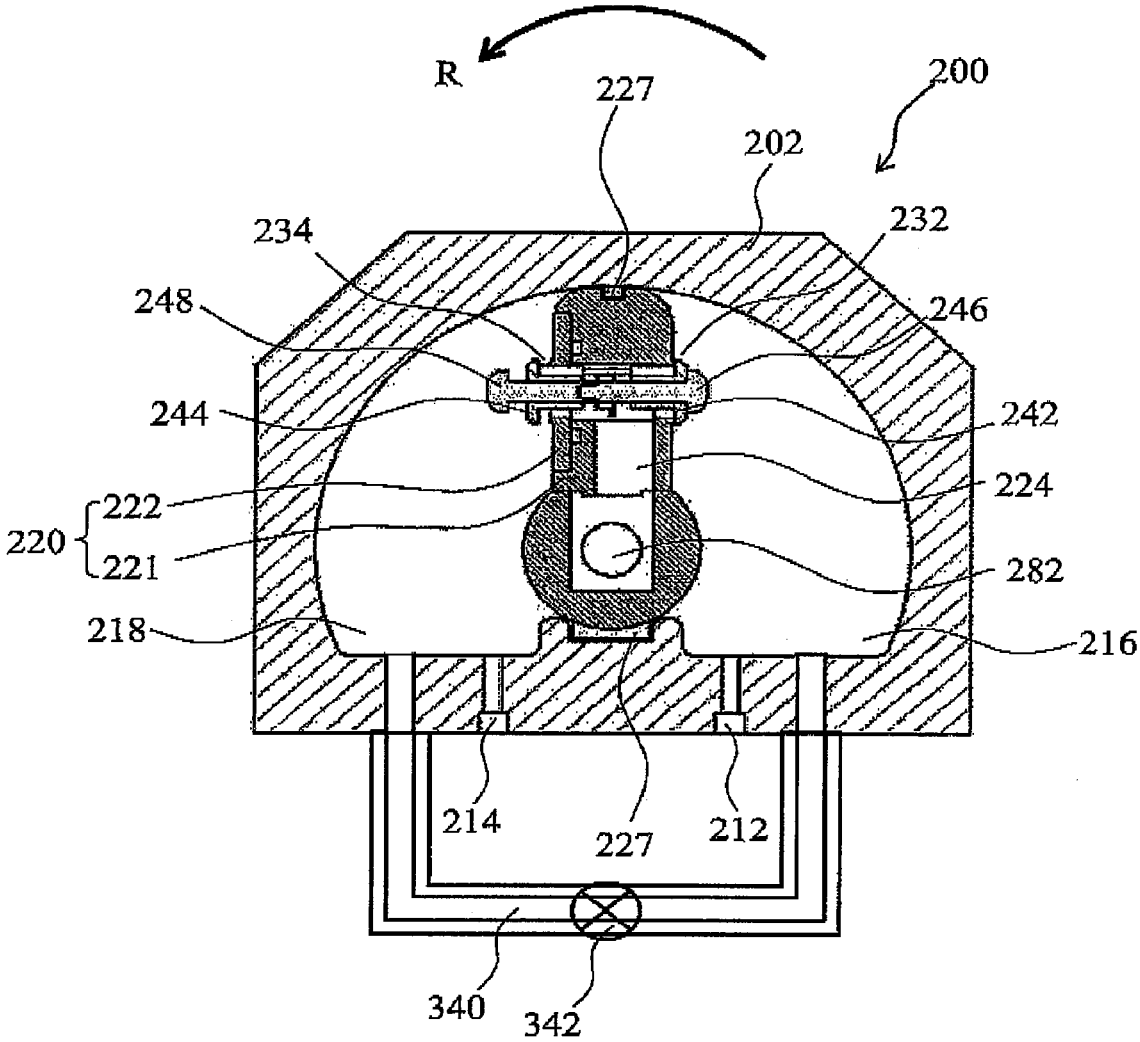
FIG. 20 is a cross section showing driving unit 200 according to the example of the invention.

FIG. 20 is a cross section showing driving unit 200 according to the example.

In the case of this example, bypass channel 340 is provided communicating pressure chamber 216, 218 formed from side to side of core 220. Moreover, switching valve 342 is provided in the bypass channel 340. Operation of switching valve 342 makes it possible to stop core 220 and control the speed.

That is, when right and left pressure chambers 216, 218 are communicated to bypass channel 340 by opening switching valve 342, water is bypassed from the pressure chamber of which the volume should have increased to the pressure chamber of which the volume should have decreased. For example, as shown by arrow R in FIG. 20, when switching valve 342 is opened during movement of core 220 to left side, water supplied from water inlet port 212 to pressure chamber 216 is bypassed to pressure chamber 218 via bypass channel 340. As a result, enough pressure difference from side to side of core 220 does not occur and oscillating action of core 220 stops. At this time, introducing port 234 is kept to be opened, thus water discharge continues and the flow amount of water discharge does not almost change. More specifically, while maintaining water discharge, core 220 can be stopped at any position.

On the other hand, when the opening of switching valve 342 is adjusted, the oscillating speed of core 220 can be adjusted. That is, when the amount of bypass water flow via bypass channel 340 is smaller, the speed of core 220 becomes higher, and when the amount of bypass water flow via bypass channel 340 is larger, the speed of core 220 becomes lower. Therefore, adjusting the opening of switching valve 342 makes it possible to adjust the speed of core 220.

In the case of this example, one switching valve 342 can stop core 220 or control the speed independently of the oscillating direction of core 220. The channel resistance of the right and left water channel extending to water inlet ports 212, 214 does not change, therefore, the pressure loss in a water inlet pass does not change and the total amount of water discharge can be kept substantially constant during normal operation, during stopping, and during decreasing speed also.

In addition, bypass channel 340 is preferred to communicate with pressure chamber 216, 218 at both ends of the inside space of housing 202. That is, the opening port of bypass channel 340 is preferred to be formed close to the end of housing 202 as much as possible so that bypass channel 340 is not obstructed even if core 220 is located at the end of right and left stroke.

The method of stopping of the example described above is applicable similarly to driving unit 100 described previously with reference to FIG. 1 to FIG. 13.

As described above, the oscillating speed (including stop) can be controlled, thereby a user is allowed to stop swinging motion of the shower part at desired angle while maintaining water sprinkle during taking a shower by sprinkle water from the shower part, therefore gets ease of use.

Up to this point, driving unit 100 and driving unit 200 were described.

Next, a first embodiment of the shower device with driving unit 100 described above (embodiment of the core reciprocating linear motion) is described in detail.

Figure 21:
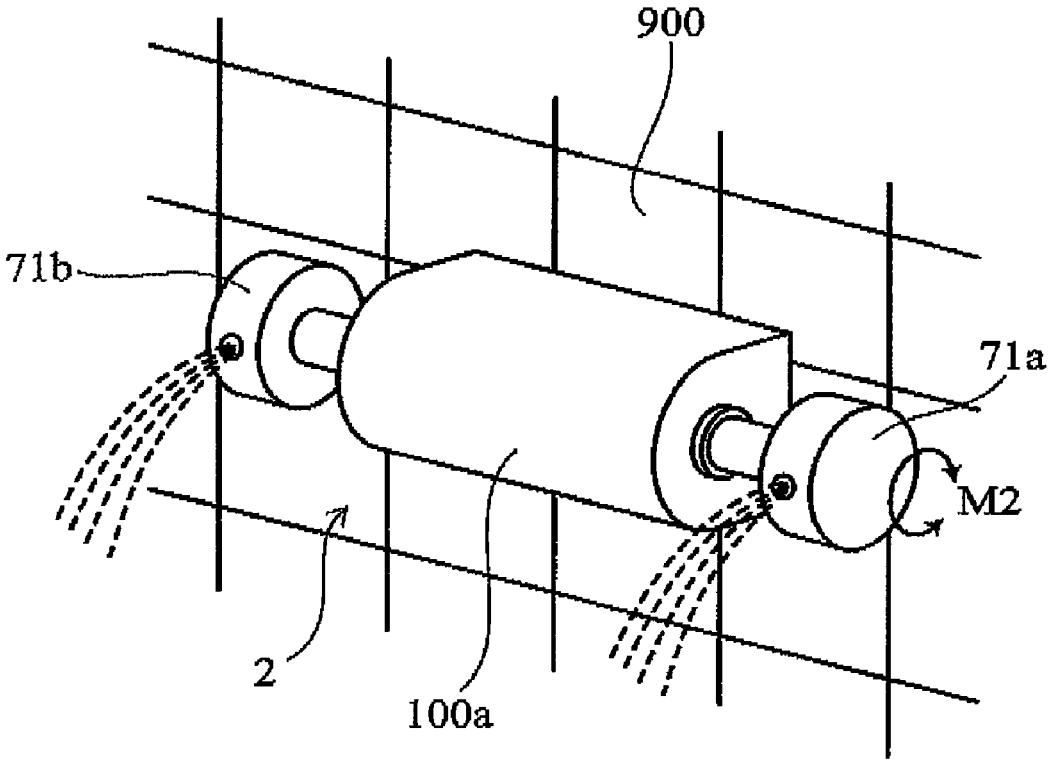
FIG. 21 is a schematic view showing shower device 2 according to a first embodiment of the invention.

FIG. 21 is a schematic view showing shower device 2 according to the embodiment. In the embodiment, shower device 2 has driving unit 100*a* described with reference to FIG. 13, and has configuration that water discharge tubular bodies protrude from both ends of the housing of driving unit 100*a* respectively. Shower part 71*a*, 71*b* are coupled to the water discharge tubular bodies. Shower device 2 is installed on wall surface 900 of a bathroom or the like, and the water discharge tubular bodies of driving unit 100*a* are set so as to be possible to reciprocate in the horizontal direction.

The water discharge tubular bodies of driving unit 100*a* are provided with a water discharge channel, water supplied into driving unit 100*a* is introduced into shower part 71*a*, 71*b* through the water discharge channel, and water is sprinkled from shower sprinkle port provided at shower part 71*a*, 71*b*. Reciprocating linear motion of the core makes the shower part swing via converting mechanism (not shown). In this way, the so-called swinging motion can be possible, which makes it possible to change periodically the direction of sprinkle while sprinkling water from shower part 71*a*, 71*b* by swinging shower part 71*a*, 71*b* in the direction of arrow M2 via operation of driving unit 100.

In addition, the water discharge channel inside the water discharge tubular body plays a role as a water guide channel introducing water flowed in from the core into the shower part. And the power transmission part in this embodiment is comprised of the water discharge tubular body coupled to the core and the converting mechanism.

Such sprinkled water is poured onto the shoulders or the like of a user. Then, because the water discharge position is varied periodically, the massage effect of the so-called "Utaseyu" (water falling down on a user's body like a waterfall) can act more extensively and effectively. Furthermore, because the user does not need to move his/her body for varying the site of action, the usability is improved. Moreover, the discharged water can also be sprayed onto the body extensively to achieve a relaxation effect, and the usability is improved.

Here, 'swinging motion' in this embodiment means by action of the shower part described above. That is, the shower part having the sprinkle port has a swinging axis, and the shower part swings about the axis. At this time, the opening direction of the sprinkle port of the shower part is substantially perpendicular to the swinging axis. In this way, the region allowing the shower part to exist can be reduced and maintained to be substantially constant while discharging water in a broad area by swinging action of the shower part, therefore, the shower device with improved design can be realized. Moreover, the swinging axis is preferred to be provided close to the sprinkle port of the shower part. Furthermore, in the state of the shower device installed, the sprinkle port is preferred to be provided more forward than the swinging axis. In addition, because the shower part is that swings vertically, the swinging axis in this embodiment is provided substantially parallel to a floor surface.

Next, a second embodiment of the shower device with driving unit 200 described above (embodiment of the core oscillating) is described in detail.

Figure 22:
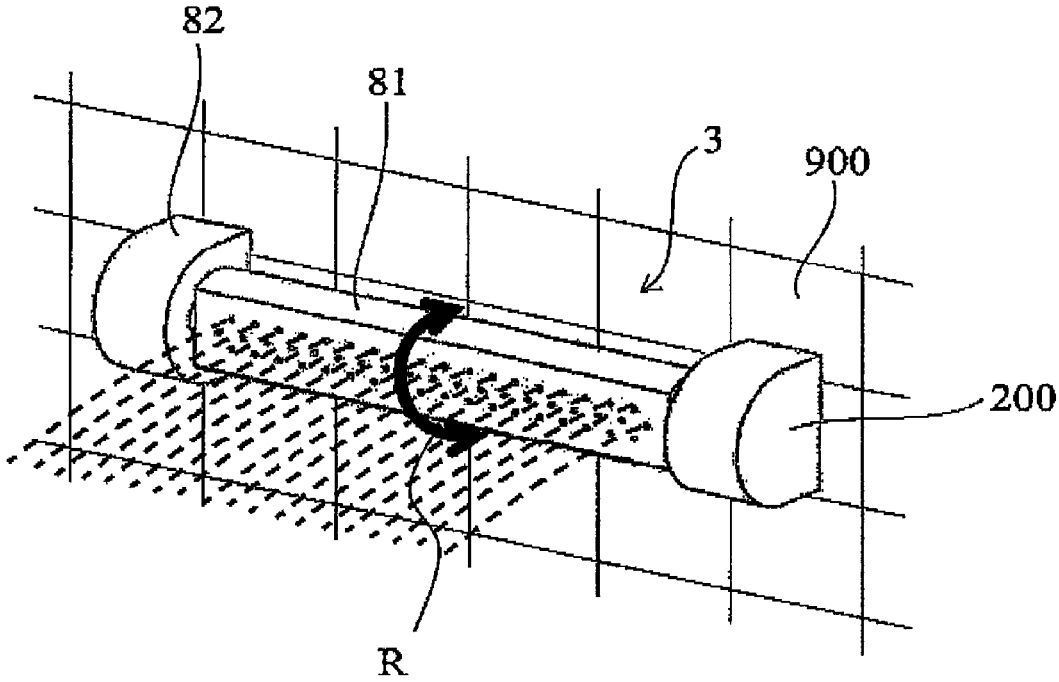
FIG. 22 is a schematic view showing shower device 3 according to a second embodiment of the invention.

FIG. 22 is a schematic view showing shower device 3 according to a second embodiment. Shower device 3 is installed on wall 900 of a bathroom or the like, and shower part 81 is coupled to the water discharge tubular body of driving unit 200. Moreover, another end from the side of driving unit 200 of shower part 81 is supported by support portion 82.

The water discharge tubular body of driving unit 200 is provided with a water discharge channel, water supplied into driving unit 200 is introduced into shower part 81 through the water discharge channel, and water is sprinkled from shower sprinkle port provided at shower part 81. Here, the water discharge tubular body oscillates as shown by arrow R by operation of driving unit 200, as a result oscillating motion, that is, swinging motion can be possible while shower part 81 also sprinkling water. That is, the direction of shower sprinkle can be changed periodically.

Shower device 3 of this embodiment can sprinkle shower water to a wide area in a compact shape by swinging motion of shower part 81 as shown by arrow R and rinse user's body in a wide area, furthermore the user can take a shower effectively with free hands. Moreover, massage effect and relaxation effect by stimulation of shower changing repetitively can be expected. Furthermore, change of the shower sprinkle direction by swinging motion like this makes the region allowing shower part 81 to exist during swinging suppress, thereby, achieving good design such as the beauty of the whole of a bathroom or the layout.

In this embodiment, oscillating motion of the core can be transmitted directly to swinging motion of the shower part, therefore a more compact shower device can be achieved. And so-called swinging motion capable of changing periodically can be achieved.

In addition, the water discharge channel inside the water discharge tubular body plays a role as a water guide channel introducing water flowed in from the core to the shower part. Moreover, the power transmission part in this embodiment corresponds to the water discharge tubular body coupled to the core.

Here, 'swinging motion' in this embodiment means by action of the shower part described above. That is, the shower part having the sprinkle port has a swinging axis, and the shower part swings about the axis. At this time, the water sprinkle plane of the shower part is substantially parallel (the opening direction of the sprinkle port of the shower part is substantially perpendicular) to the swinging axis. In this way, the region allowing the shower part to exist can be reduced and maintained to be substantially constant while discharging water in a broad area by swinging action of the shower part, therefore, the shower device with improved design can be realized. Moreover, the swinging axis is preferred to be provided close to the sprinkle port of the shower part. Furthermore, in the state of the shower device installed, the sprinkle port is preferred to be provided more forward than the swinging axis. In addition, because the shower part is that swings vertically, the swinging axis in this embodiment is provided substantially parallel to a floor surface.

Next, a third embodiment of the shower device with driving unit 200 described above (embodiment of the core oscillating) is described in detail.

Figure 23:
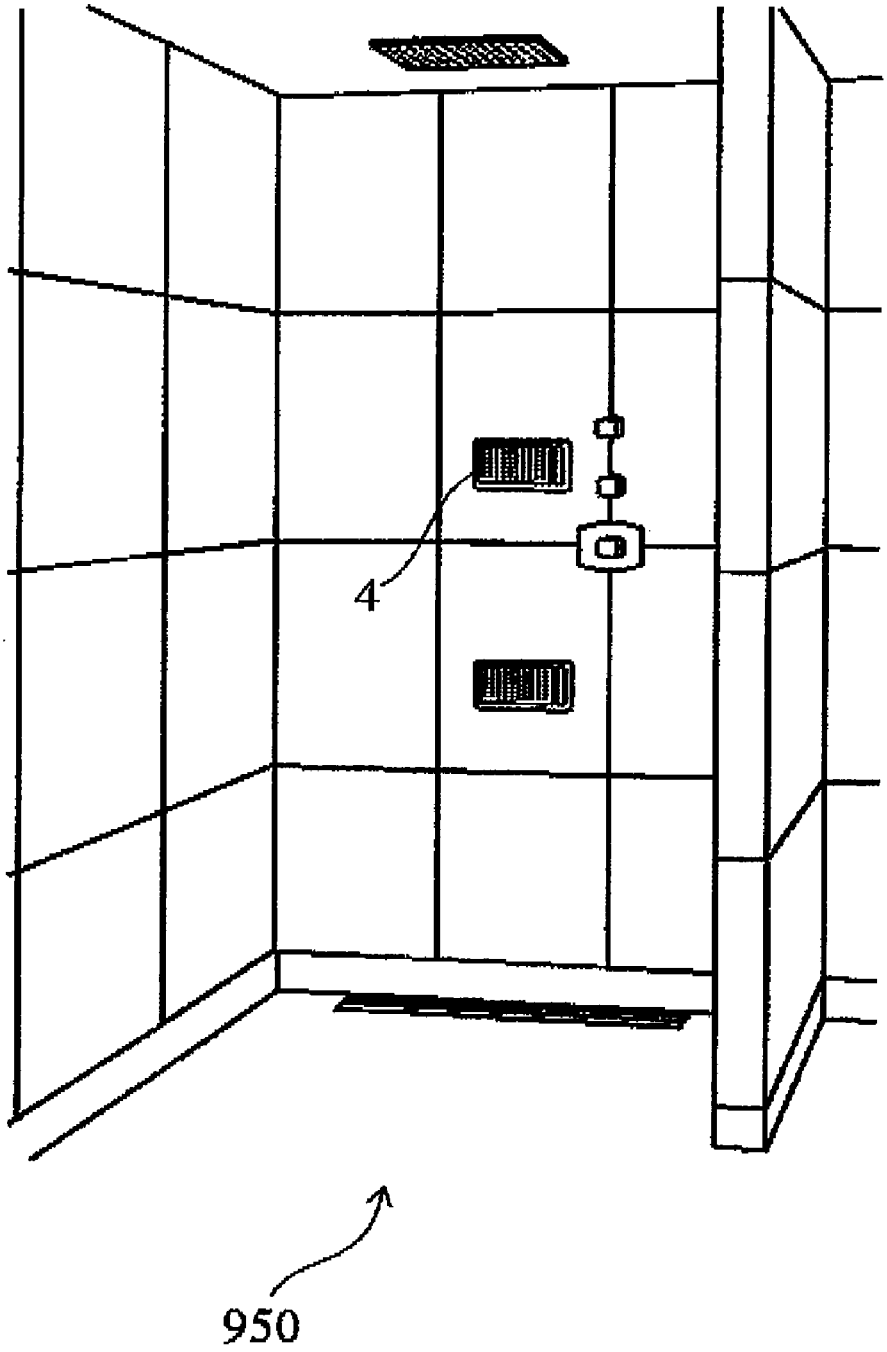
FIG. 23 is a schematic view of shower booth 950 installed with the shower device 4 according to a third embodiment of the invention.

FIG. 23 is a schematic view showing shower booth 950 installed with shower device 4 according to this embodiment.

Figure 24:
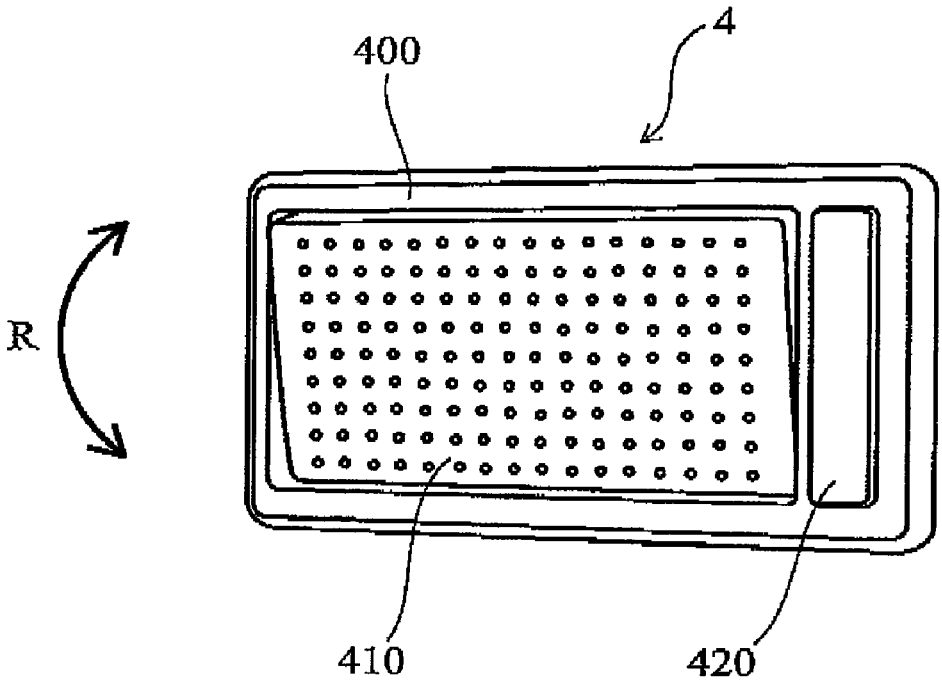
FIG. 24 is a schematic view illustrating the external appearance of shower device 4.

Moreover, FIG. 24 is a schematic view illustrating the appearance of shower device 4 of this embodiment.

Shower device 4 of this embodiment includes flame 400, and shower part 410 and switch 420 supported by this flame. Flame 400 is allowed to be embedded in a wall of shower booth 950 and a bathroom or the like. FIG. 23 illustrates the case of usage as a body shower, however this invention is not limited to this example. Shower device 4 is installed on a ceiling of shower booth 950 and a bathroom or the like, and can be used as an overhead shower.

Shower part 410 swings up and down in the direction of arrow R. FIG. 24 shows shower part 410 pointing downward a little. In this way, shower part 410 swings up and down, thereby a user standing in front of shower device 4 can take a shower over a broad region of the body with free hands. As a result the user can not only take a shower effectively but also can get comfortable feeling of massage, because a shower water sprinkling part about the body changes periodically.

Furthermore, according to this embodiment, shower device 4 can be embedded in the wall of the shower booth and the bathroom. This not only allows a simple and good appearance but also can prevent giving an oppressive feeling to a user and colliding with the body in a tight shower booth and a bathroom or the like.

In the following, the structure of shower device 4 of this embodiment will be described.

Figure 25:
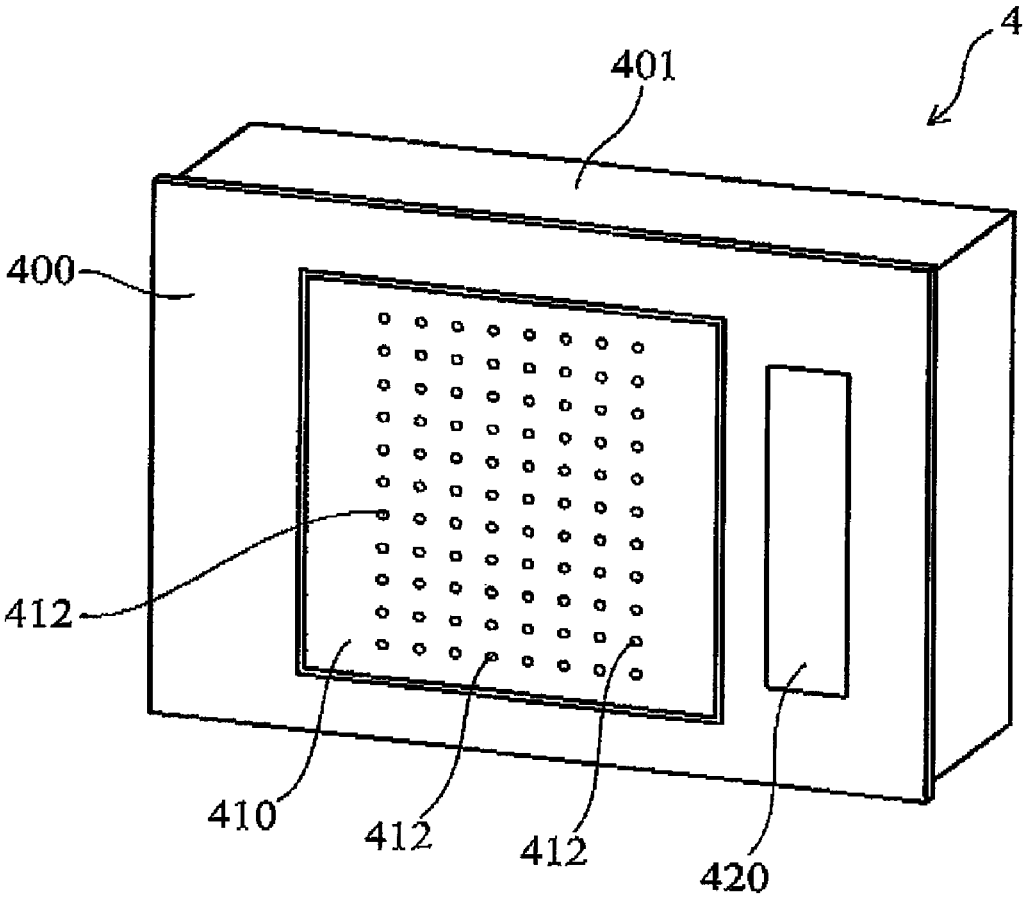
FIG. 25 is a perspective view of shower device 4 as viewed from on high at an angle.

FIG. 25 is a perspective view of shower device 4 of this embodiment as viewed from on high at an angle.

Figure 26:
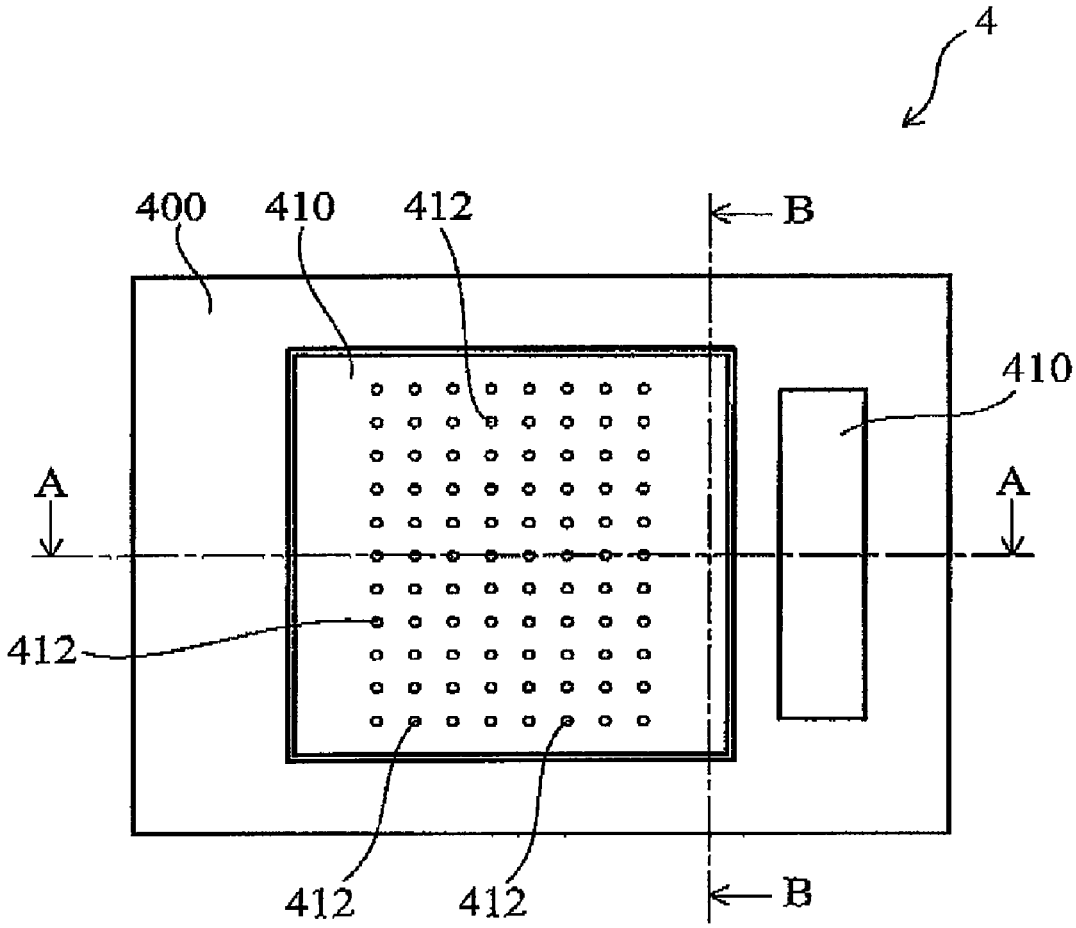
FIG. 26 is a front view of shower device 4.

Moreover, FIG. 26 is a front view of shower device 4.

Figure 27:
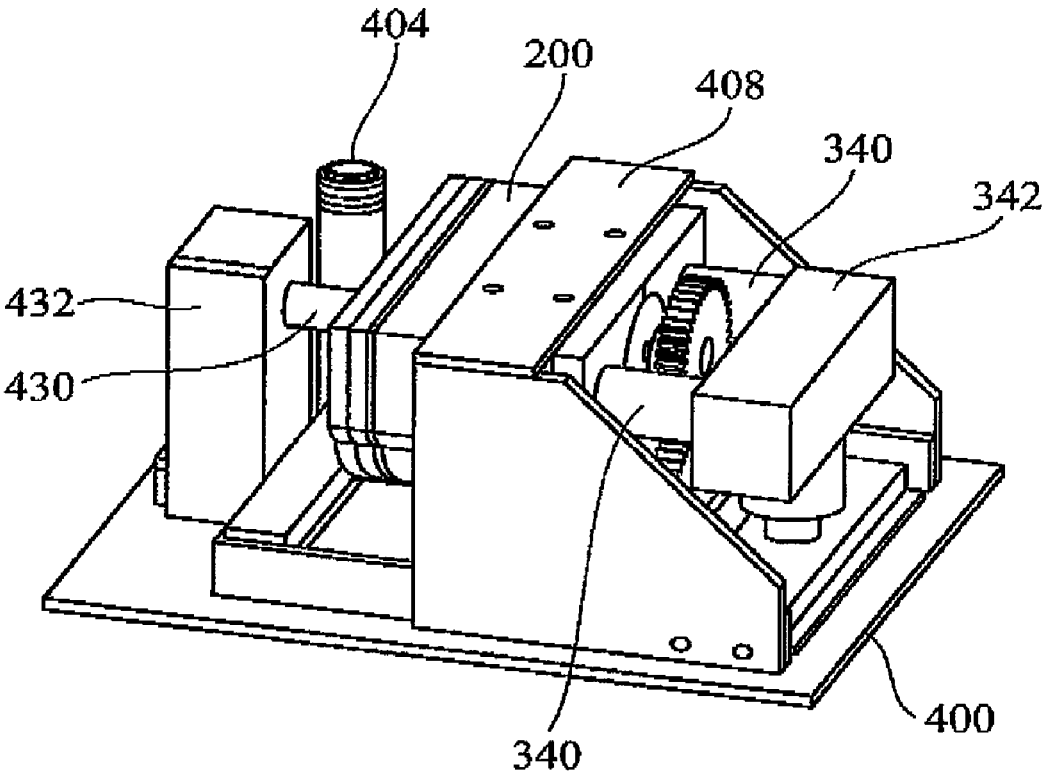
FIG. 27 is a perspective view of shower device 4 as viewed from the rear at an angle.

Additionally FIG. 27 is a perspective view of shower device as viewed from the rear at an angle.

In addition, shower device 4 shown in FIGS. 25 to 27 has a little different appearance from those shown in FIG. 23 and FIG. 24, but has the same interior structure.

Shower part 410 is provided with plural shower sprinkle ports 412 in two dimensions with dual orientation, is allowed to sprinkle water in a broad area. Supporting flame 408 is provided in the interior protected by casing 401 on the back side of flame 400, and driving unit 200 is fixed described previously with reference to FIGS. 14 to 20. Fixed water guide channels 430, 432 fixed to flame 400 without associating with core 220 are provided at one end of driving unit 200, and introduce water to shower part 410. On the other hand, at another end of driving unit 200, bypass channel 340 and switching valve 342 described previously with reference to FIG. 20 are provided. Switching valve 342 is allowed to switch by switch 420 provided in front of flame 400. Furthermore, oscillating motion of the core of driving unit 200 is transmitted to gear 450 and causes shower part 410 to swing. Moreover, casing 401 accommodating parts of the shower device such as supporting flame 400 and driving unit 200 is provided on the back side of flame 400. In addition, a part of water supplier 404 is protruded outside casing 401 and coupled to a water supply pipe on back of the wall. At this time, the coupling part between water supplier 404 and casing 401 is covered by a seal member.

Figure 28:
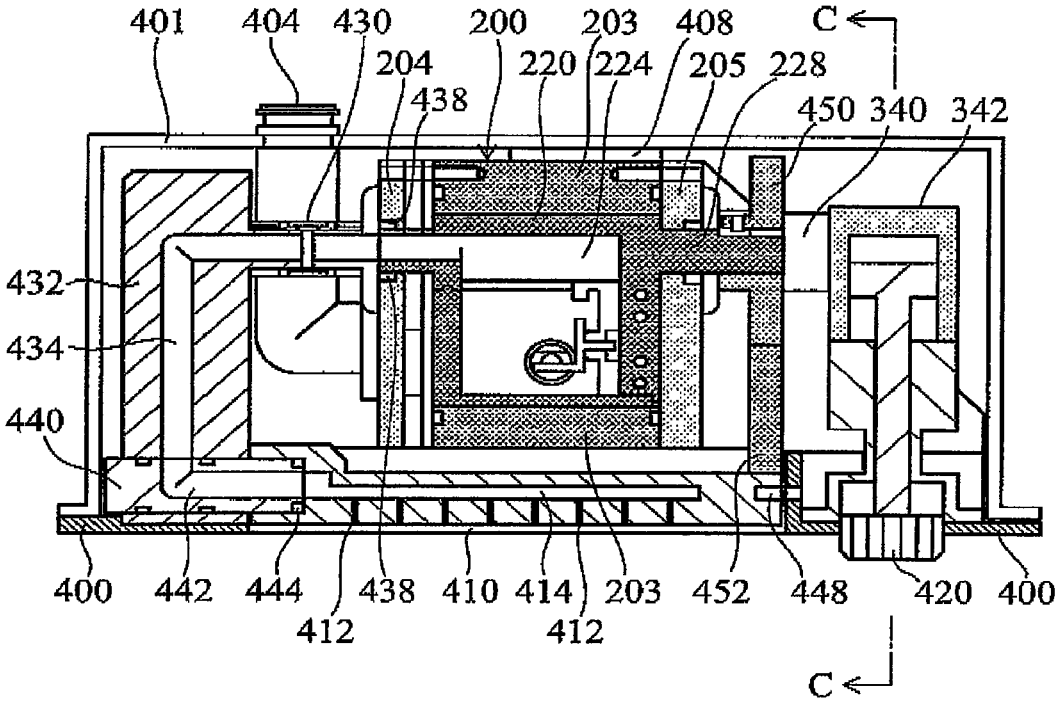
FIG. 28 is a cross section along line A-A in FIG. 26.

FIG. 28 is a cross section along line A-A in FIG. 26.

Figure 29:
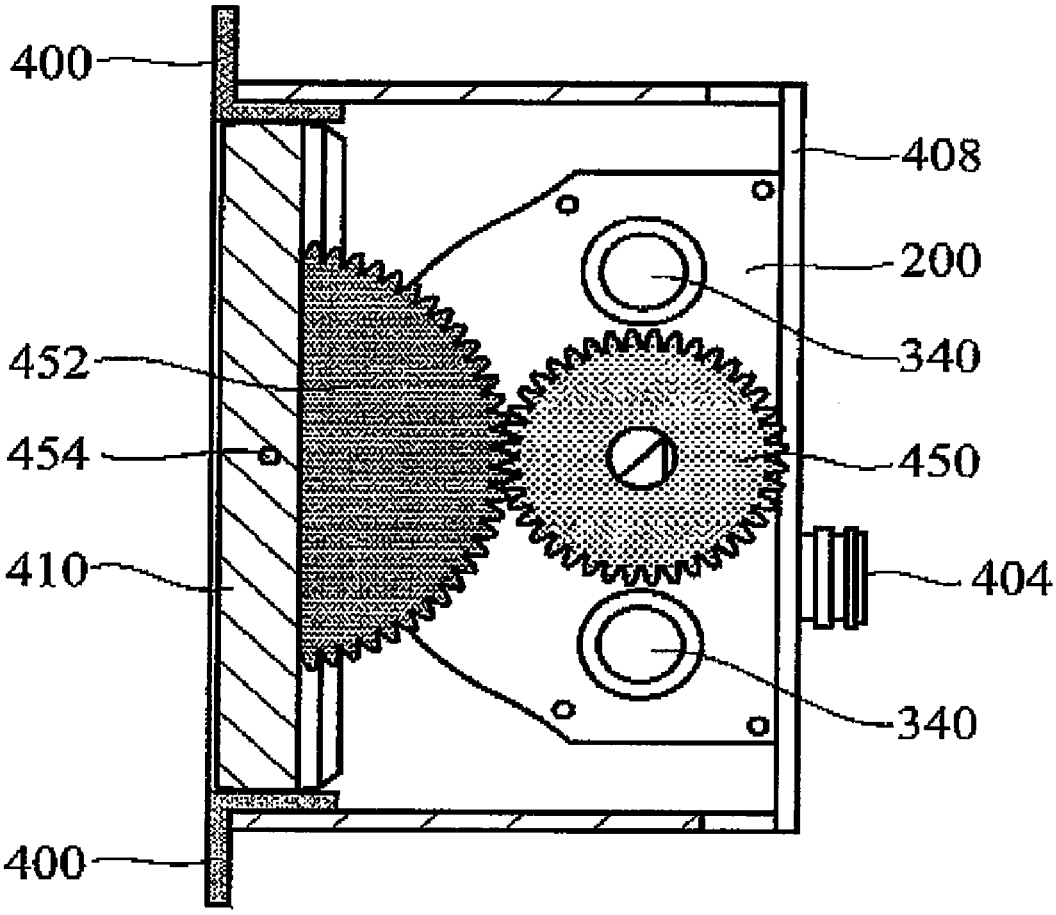
FIG. 29 is a cross section along line B-B in FIG. 26.
Figure 30:
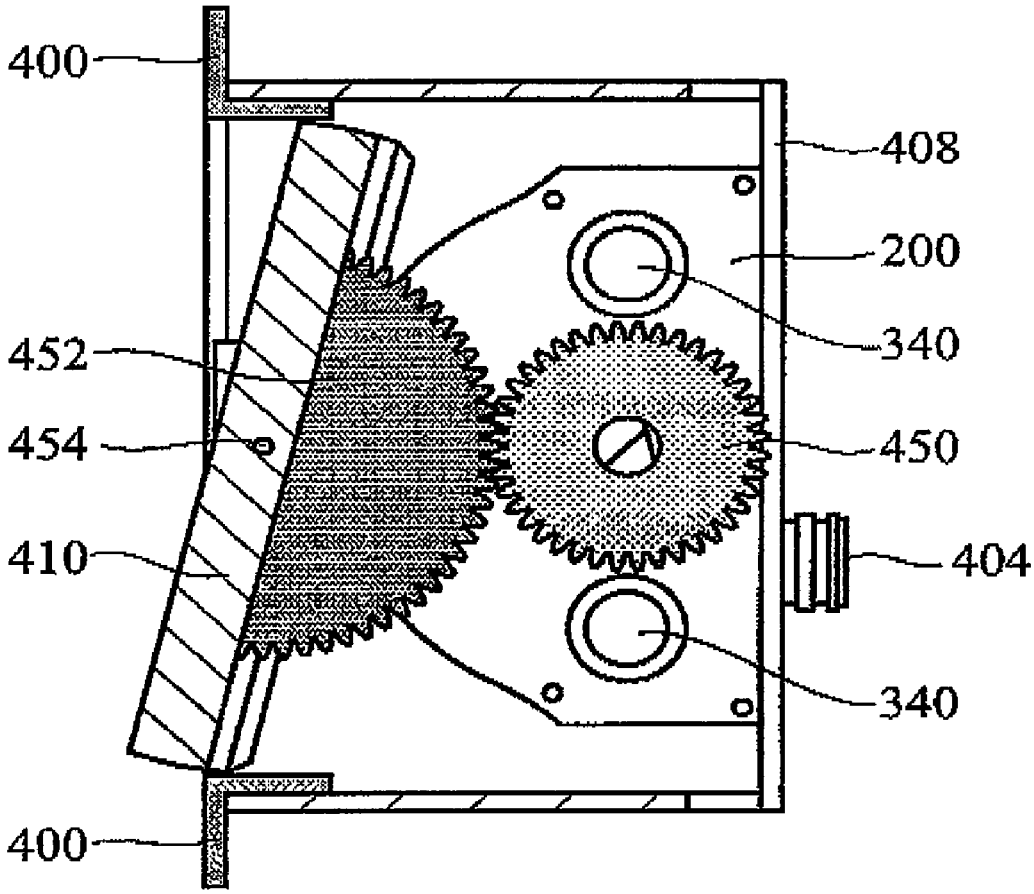
FIG. 30 is a cross section along line B-B in FIG. 26.
Figure 31:
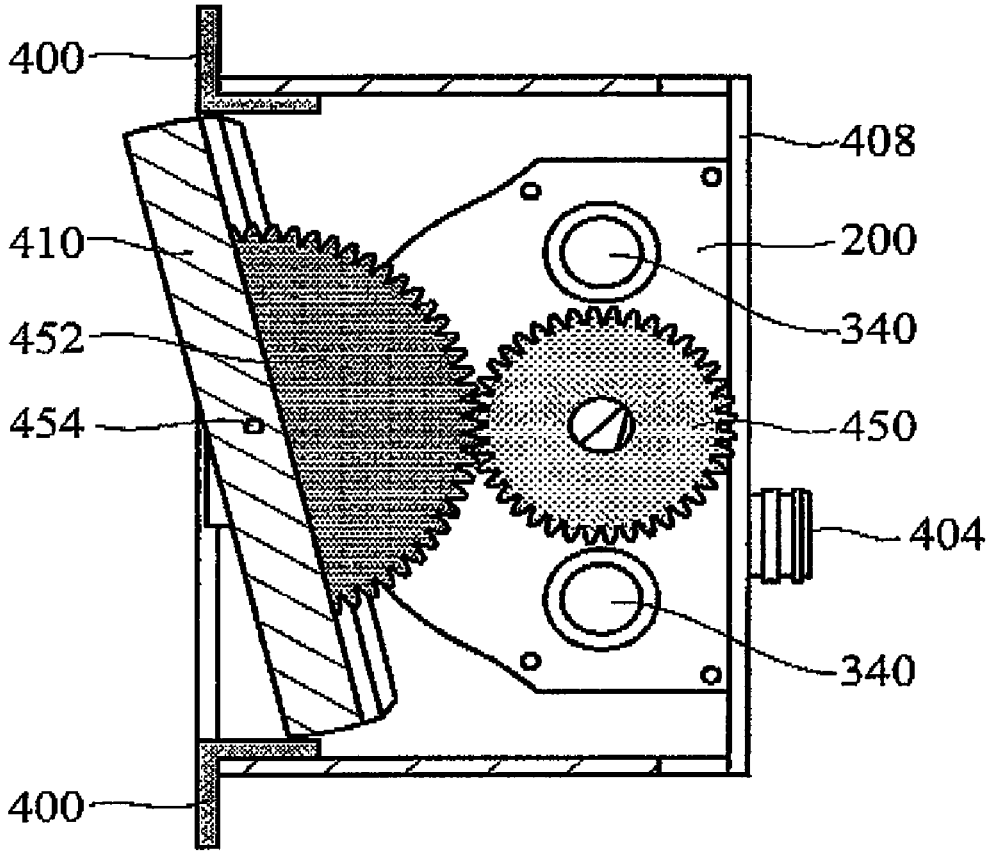
FIG. 31 is a cross section along line B-B in FIG. 26.

Moreover, all of FIGS. 29 to 31 are cross sections along line B-B in FIG. 26.

One end of shower part 410 is axially supported by axial supporting part 440 and the other end is axially supported by axial supporting part 448.

Water supplied from a water supply source not shown in the figures is introduced to water supplier 404. As described previously with reference to FIGS. 14 to 20, water introduced to water supplier 404 is introduced to water inlet ports 212, 214 (See FIG. 19), causes core 220 to oscillate. And water introduced into core inner channel 224 is supplied to water guide channel 414 provided in shower part 410 via water guide channel 434 provided in fixed water guide channel 430, 432 and axial supporting part 440, and sprinkled from shower sprinkle port 412. Seal 438 such as O-ring or the like is provided between core 220 oscillating and fixed water guide channel 430. Moreover, seal 444 such as O-ring or the like is provided between swinging shower part 410 and fixed axial supporting part 440, too.

One end 228 of core 220 in driving unit 200 penetrates housing lid 205 and protrudes, where is fixed to gear 450 and transmits oscillating motion of core 220 to gear 450. Gear 450 transmits oscillating motion to gear 452 which is fixed to shower part 410 (power transmission part). As a result, shower part 410 swings. FIG. 29 shows the state of shower part 410 facing front face, FIG. 30 shows the state of shower part 410 facing up at an angle and FIG. 31 shows the state of shower part 410 facing down at an angle. Movable range of shower part 410 can be, for example, in a range between about plus and minus 30 degrees. In this way, oscillating motion of core 220 causes shower part 410 to swing repetitively up and down.

According to this embodiment, by choosing a size of driving unit 200 and a gear ratio of gear 450 and 452, period of swinging motion of shower part 410 can be a few hertz. When sprinkling water in a broad region of the body of a user, the period of swinging motion of shower part 410 is not proper neither for too fast nor for too slow in order to give comfortable feeling of massage. Because the user can not feel change of a body part receiving shower.

The frequency of swinging motion of shower part 410 is preferred to be 0.1 hertz or more and 5 hertz or less to give a comfortable feeling of massage and effect of working out of stiffness. Moreover, it is more effective when the frequency is 0.2 hertz or more and 3 hertz or less. Furthermore, when the frequency is 0.3 hertz or more and 1 hertz or less, a user can receive still more comfortable feeling. According to this embodiment, swinging motion of shower part 410 can be achieved at the period like this.

Moreover, in this embodiment, the oscillating axis of oscillating motion of core 220 is different from the swinging axis of swinging motion of shower part 410. That is, the oscillating axis of oscillating motion of core 220 is provided on the back side apart from flame 400, on the other hand, the swinging axis of swinging motion of shower part 410 is provided near to flame 400. In this way, shower part 400 can be provided in front of shower flame 400 while accommodating driving unit 200 on the rear side. That is, the shower device can be provided, which has no protruding portion around shower part 400 and is easy to use with clear appearance.

On the other hand, in the shower device of this embodiment, swinging motion of shower part 410 can be stopped by operation of switch 420.

That is, bypass channel 340 and switching valve 342 are provided in driving unit 200 and bypass channel 340 is allowed to be switched by switch 420.

Figure 32:
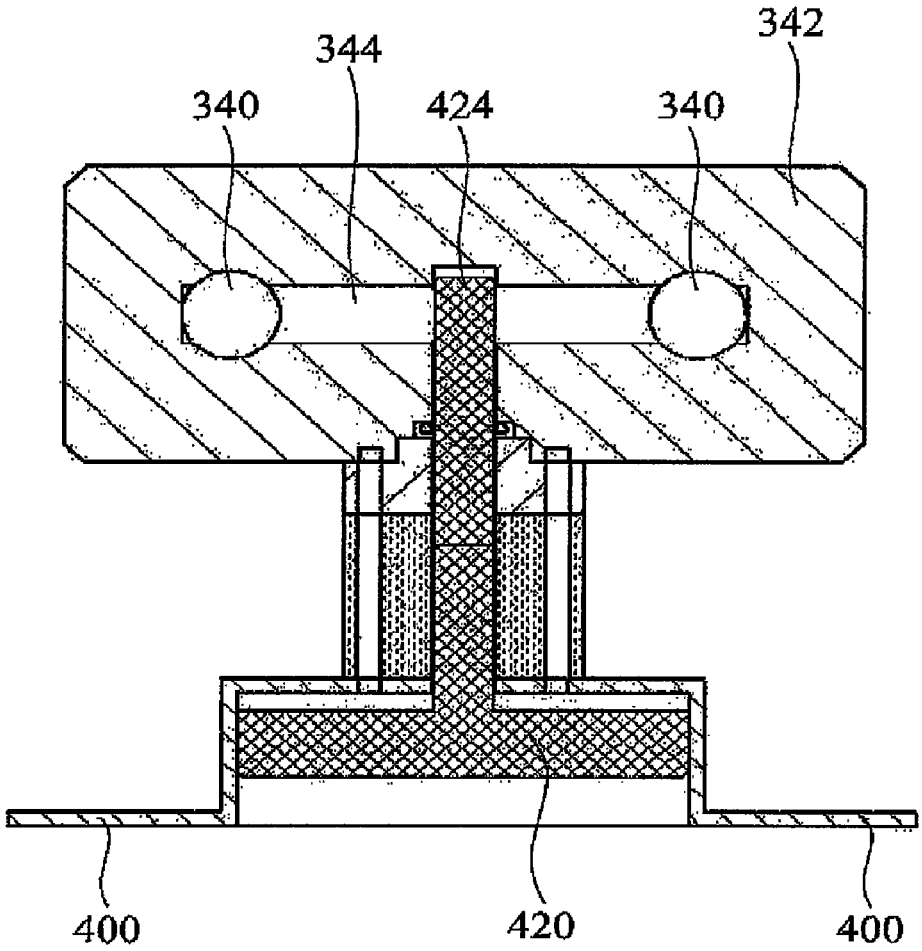
FIG. 32 is a cross section along line C-C in FIG. 28.
Figure 33:
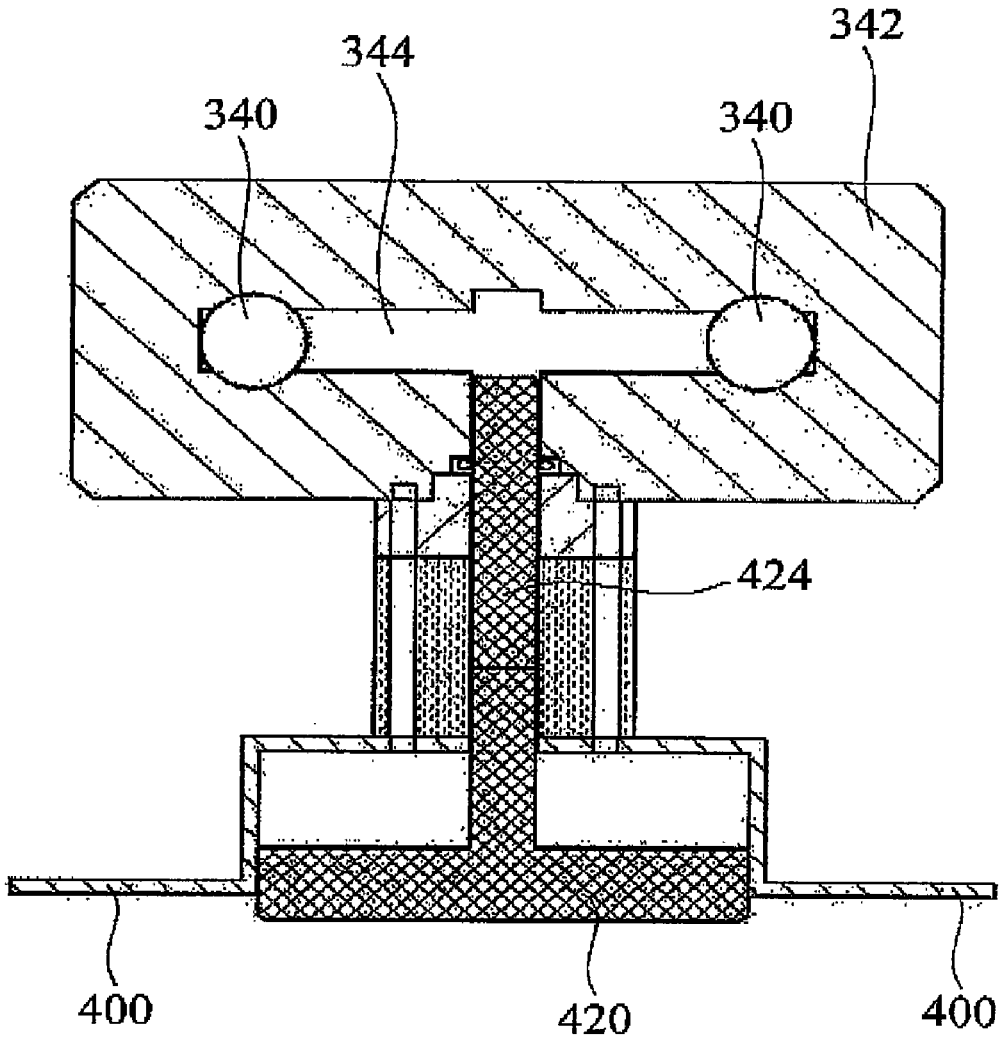
FIG. 33 is a cross section along line C-C in FIG. 28.

FIG. 32 and FIG. 33 are cross sections along line C-C in FIG. 28.

Valve inner channel 344 existing on a way to bypass channel 340 is provided in the interior of switching valve 342. And screening body 424 is supported so as to be capable of switching valve inner channel 344. FIG. 32 shows the state that switch 420 is pushed and valve inner channel 344 is interrupted by forward movement of screening body 424. In this state, bypass channel 340 is interrupted, therefore, as described previously with reference to FIG. 20, core 220 in driving unit 200 oscillates and shower part 410 swings.

On the other hand, as shown in FIG. 33, in the state of switch 420 being unpushed, valve inner channel 344 is opened by backward movement of screening body 424. In this state, bypass channel 340 is not interrupted, therefore, as described previously with reference to FIG. 20, the pressure difference between right and left pressure chamber 216, 218 diminishes and core 220 stops. That is, shower part 410 stops without swinging motion. Moreover, in this state, for example, a user can also change the direction of shower part 410 freely by pushing shower part 410 in either direction of up or down. That is, in the state of shower 410 of stopping swinging motion, the direction of water sprinkle can be changed depending on user's preference, providing excellent usability.

In addition, switch 420 is allowed to hold the state shown in FIG. 32 and the state shown in FIG. 33, respectively by providing a biasing means and a latch mechanism or the like. That is, every time of pushing switch 420, the state shown in FIG. 32 and the state shown in FIG. 33 are realized alternatively, and a user can enjoy taking a shower by swinging motion of shower part 410 leaving one's hands from switch 420.

FIGS. 34 to 38 are schematic views showing variations of mechanism switching bypass channel 340.

Figure 34:
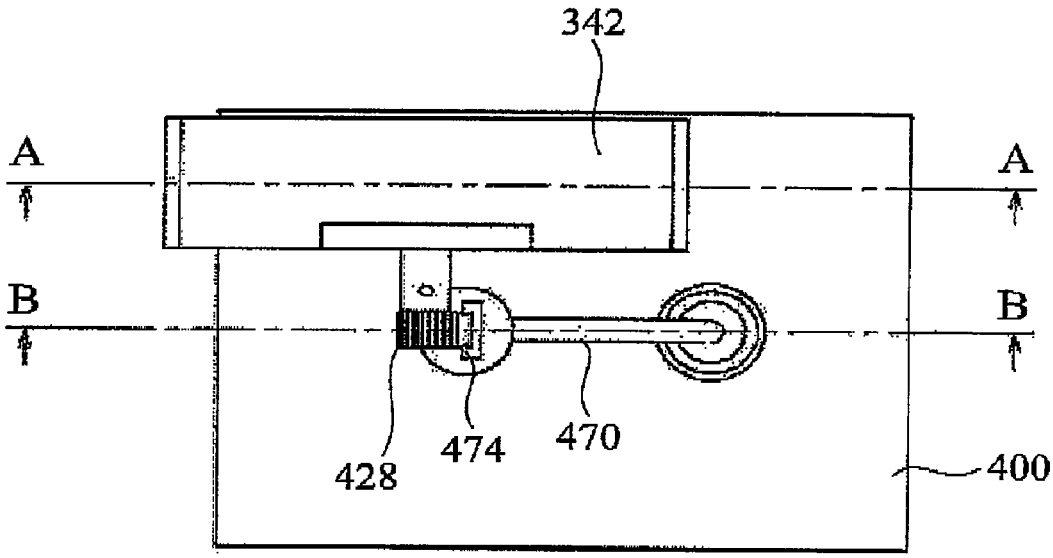
FIG. 34 is a schematic view of the part of the switching mechanism as viewed from the back side of flame 400.

That is, FIG. 34 a schematic view of the part of the switching mechanism as viewed from the back side of flame 400.

Figure 35:
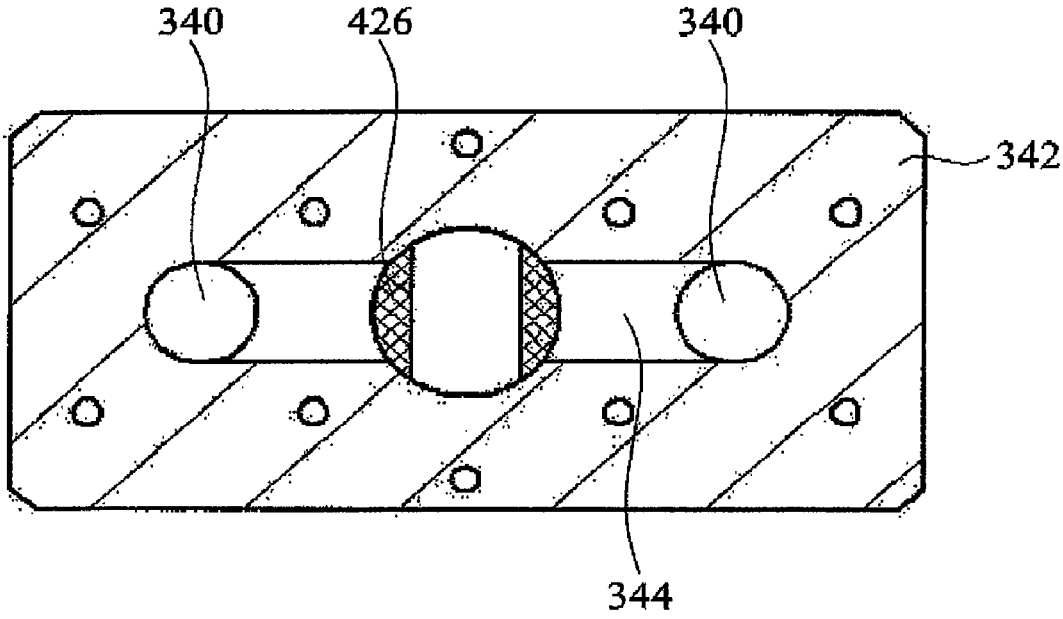
FIG. 35 is a cross section along line A-A in FIG. 34.
Figure 36:
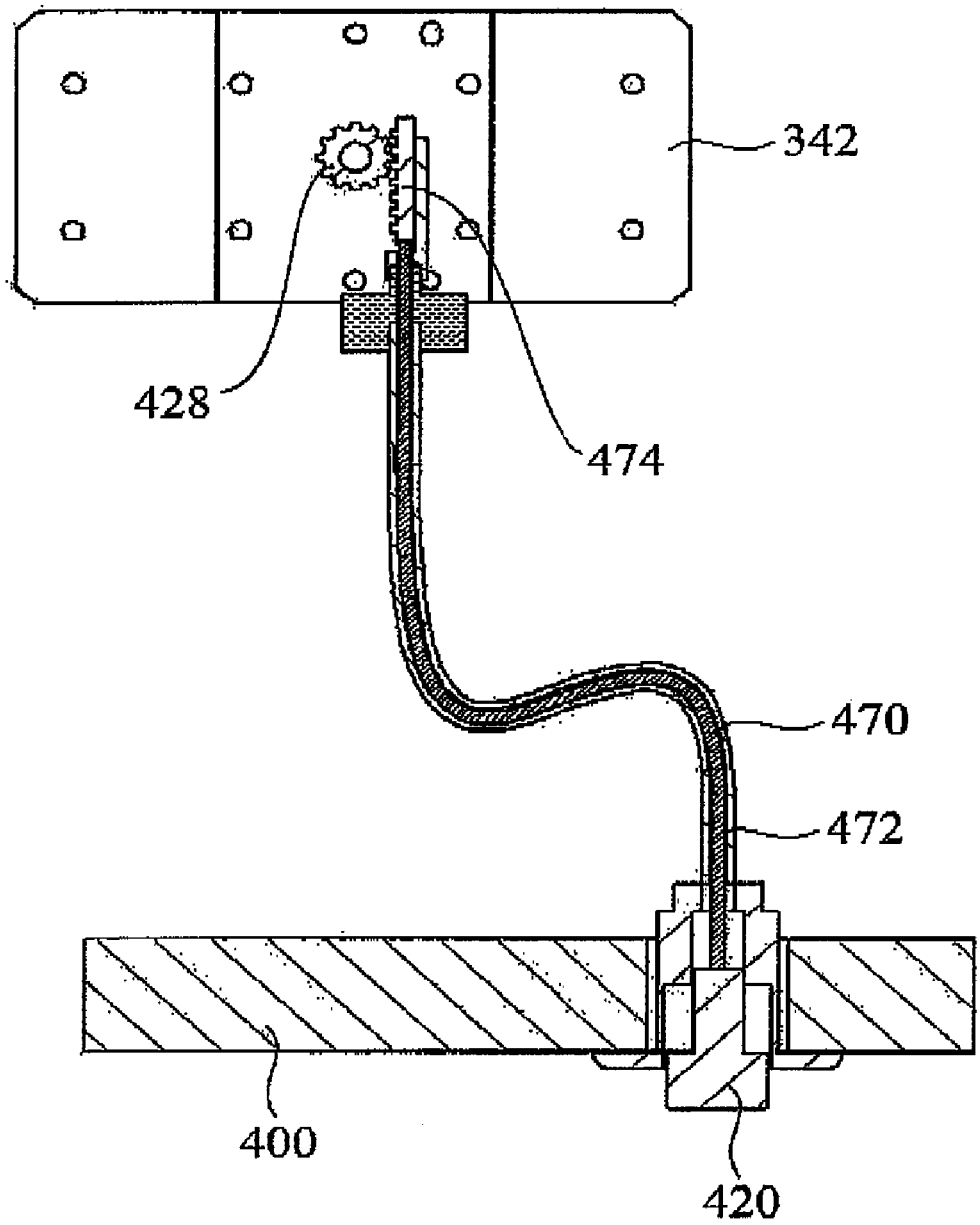
FIG. 36 is a cross section along line B-B in FIG. 34.
Figure 37:
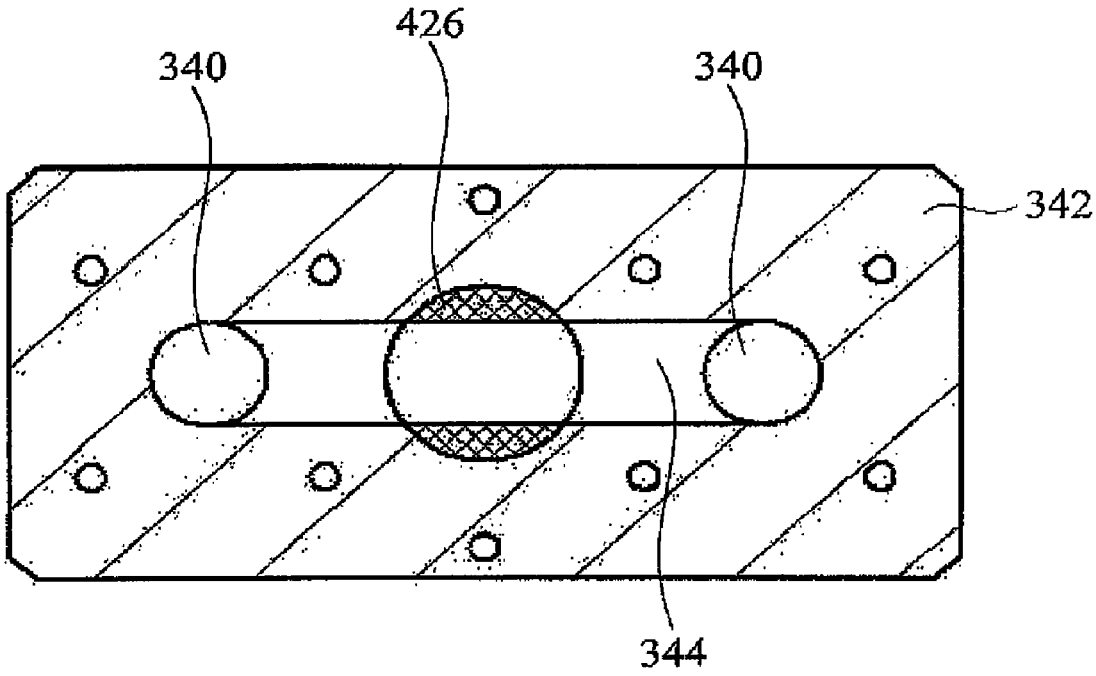
FIG. 37 is a cross section along line A-A in FIG. 34.
Figure 38:
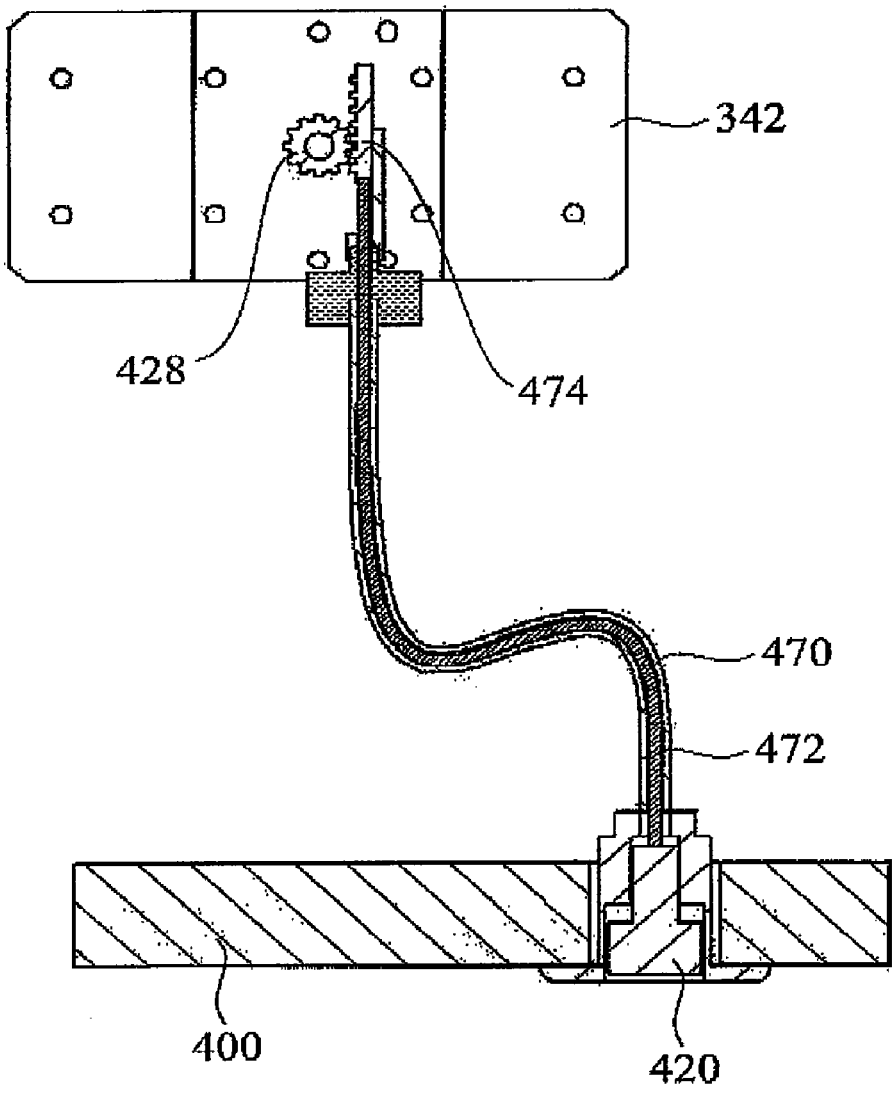
FIG. 38 is a cross section along line B-B in FIG. 34.

Moreover, FIG. 35 and FIG. 37 are cross sections along line A-A in FIG. 34, and FIG. 36 and FIG. 38 are cross sections along line B-B in FIG. 34.

Also in this variation, switching valve 342 is provided on a way to bypass channel 340. Valve inner channel 344 is provided in the interior of switching valve 342 and is allowed to be switched by rotating screening body 426. Screening body 426 is driven by gear 428. Wire 472 slidably kept in guide 470 is coupled to switch 420. The tip of wire 472 is coupled to rack 474. When switch 420 is pushed, wire 472 slides and rack 474 rotates gear 428. Rotation of gear 428 is transmitted to screening body 426 and valve inner channel 344 is switched.

As shown in FIG. 35 and FIG. 36, in the state of screening body 426 screening valve inner channel 344, core 220 in driving unit 200 oscillates and shower part 410 swings.

On the other hand, as shown in FIG. 37 and FIG. 38, in the state of screening body 426 opening valve inner channel 344, core 220 in driving unit 200 stops and shower part 410 also stops. In this way, shower part 410 can either swing or stop on depending user's preference.

Also in this variation, the state shown in FIG. 35 and FIG. 36 and the state shown in FIG. 37 and FIG. 38 are allowed to be hold, respectively by providing a latch mechanism to switch 420 and providing a biasing means to wire 472. That is, every time pushing switch 420, the state shown in FIG. 35 and FIG. 36 and the state shown in FIG. 37 and FIG. 38 are realized alternatively, and a user can enjoy taking a shower by swinging motion of shower part 410 leaving one's hands from switch 420.

Moreover, a clearance between the shower part having the shower sprinkle port and flame 400 is formed to have dimension so that hands are not caught even if shower part 410 swings. It is more preferred that an opening side plane for providing shower part 410 of the flame is formed in a shape along swinging track of the end of shower part 410 so that the clearance is substantially constant even if shower part 410 swings.

Furthermore, casing 401 is preferred to be formed in a shape of a box having an opening on the side of shower part 410 of shower device 4. In this way, even if water flows into the clearance between shower part 410 and flame 400, water does not leak to the back side of the wall by casing 401 formed in a shape of a box. It is more preferred that the bottom surface of casing 401 has a downward slope on the side of shower part 410, water flowed into casing 401 can be drained off to a bath room or shower booth.

In this embodiment, oscillating motion of the core can be transmitted to swinging motion of shower part 410 via gear 450, 452, therefore, the shower device can be more compact. And the so-called swinging motion capable of changing periodically can be achieved.

In addition, the water discharge channel in the interior of the water discharge tubular body plays a role as the water guide channel introducing water flowed in from the core to the shower part.

Here, 'swinging motion' in this embodiment means by action of the shower part described above. That is, the shower part having the sprinkle port has a swinging axis, and the shower part swings about the axis. At this time, the water sprinkle plane of the shower part is substantially parallel (the opening direction of the sprinkle port of the shower part is substantially perpendicular) to the swinging axis. In this way, the region allowing the shower part to exist can be reduced and maintained to be substantially constant while discharging water in a broad area by swinging action of the shower part, therefore, the shower device with improved design can be realized. Moreover, the swinging axis is preferred to be provided close to the sprinkle port of the shower part. Furthermore, in the state of the shower device installed, the sprinkle port is preferred to be provided more forward than the swinging axis. In addition, because the shower part is that swings vertically, the swinging axis in this embodiment is provided substantially parallel to a floor surface.

Next, a fourth embodiment of the shower device with driving unit 100 described above (embodiment of the core reciprocating linear motion) is described in detail.

Figure 39:
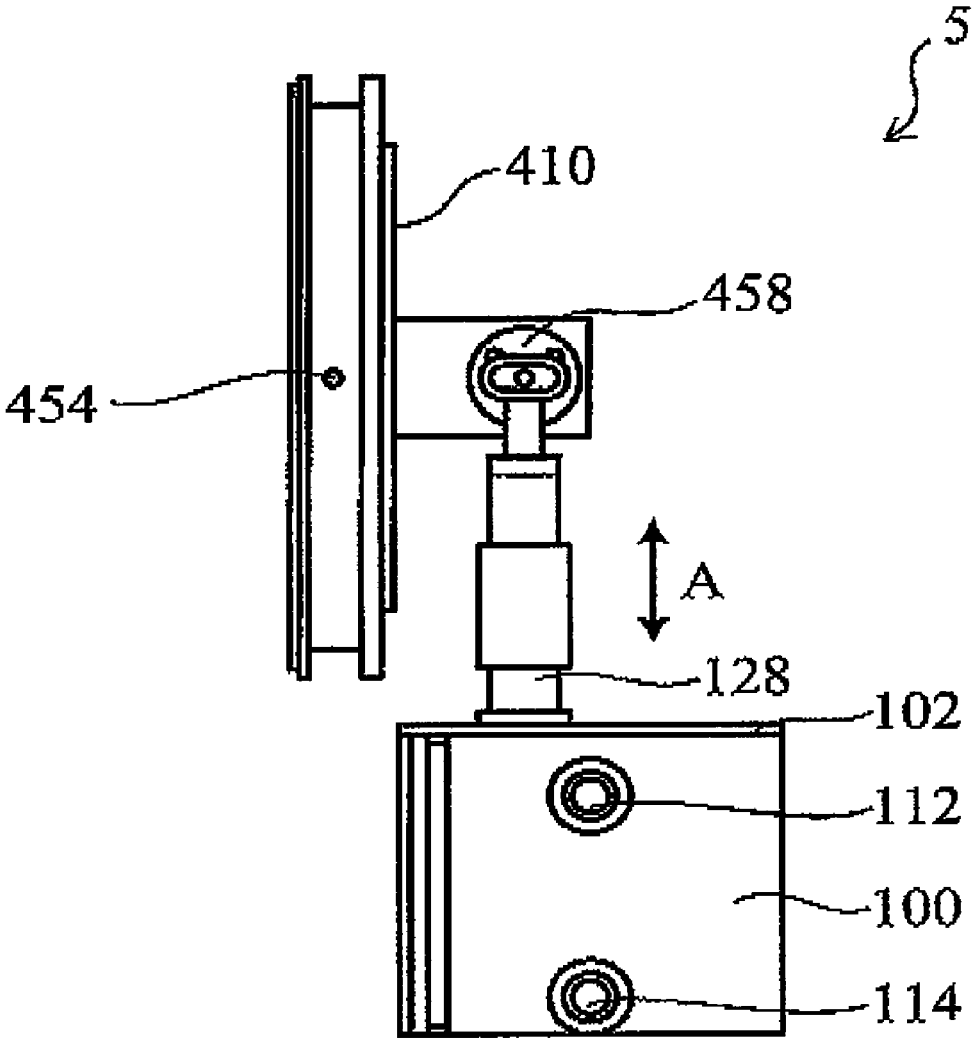
FIG. 39 is a schematic view showing a part of shower device 5 according to a fourth embodiment of the invention.
Figure 40:
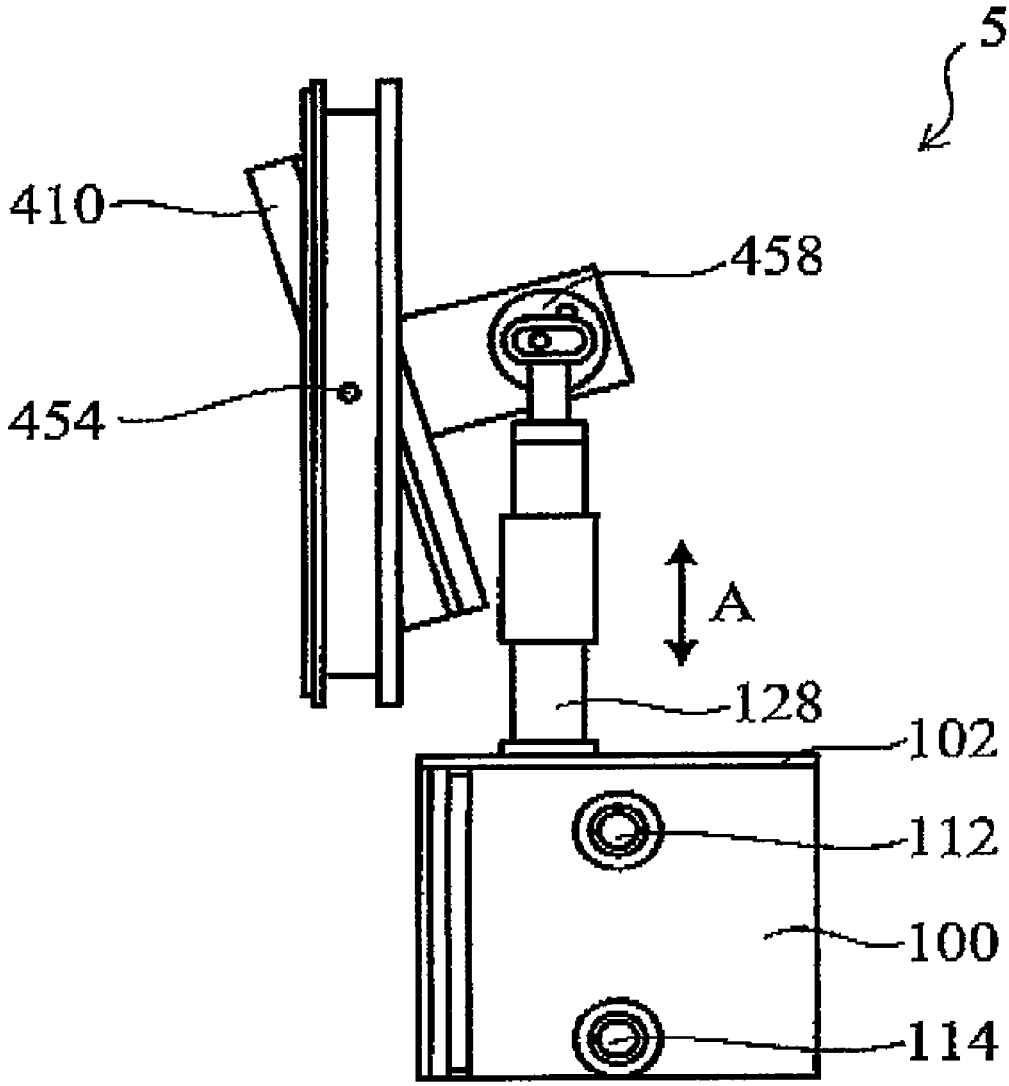
FIG. 40 is a schematic view showing a part of shower device 5 according to the fourth embodiment of the invention.
Figure 41:
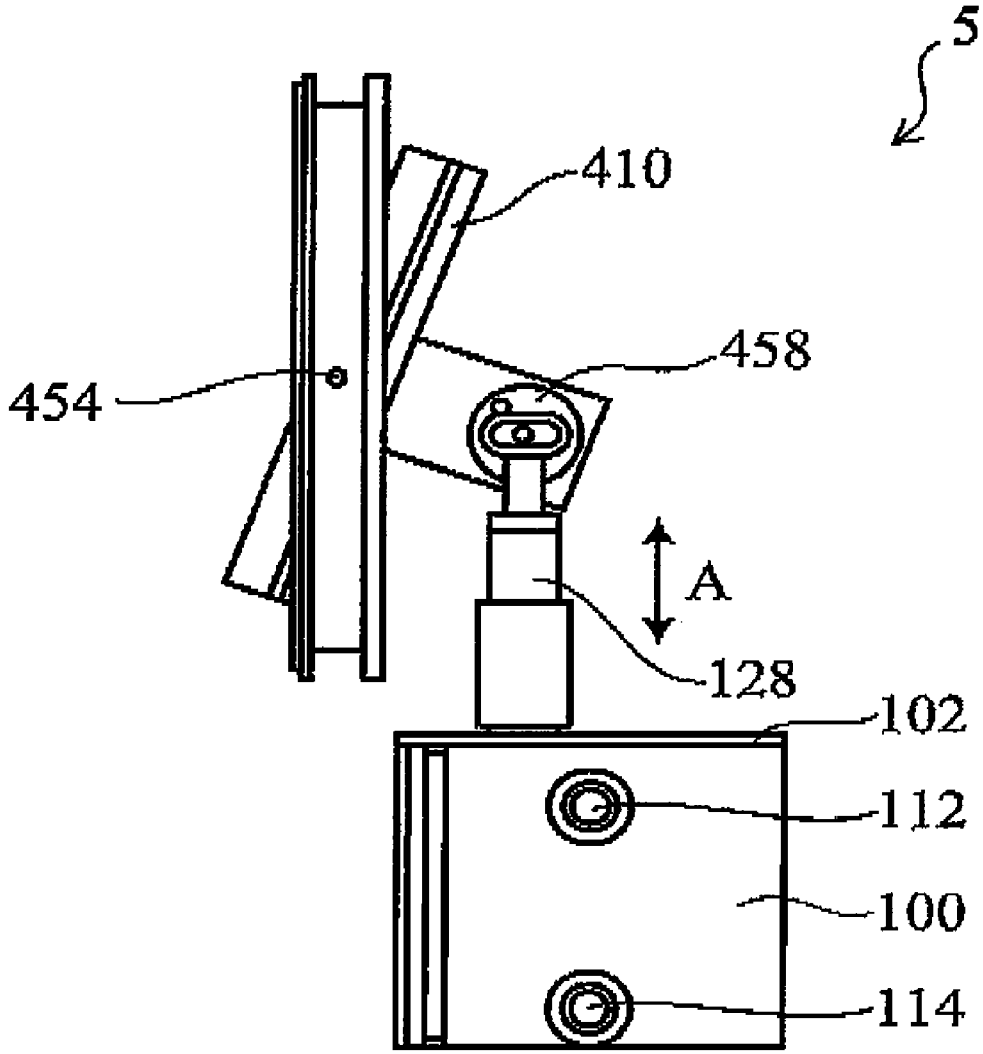
FIG. 41 is a schematic view showing a part of shower device 5 according to the fourth embodiment of the invention.

FIGS. 39 to 41 are schematic views showing a part of shower device 5 according to a fourth embodiment of the invention.

Shower device 5 of this embodiment is also provided with shower part 410 supported by the flame not shown in a figure as well as shower device 4 of the third embodiment and is allowed to be embedded in a wall of shower booth 950 and a bathroom or the like. Shower part 410 is axially supported by axial support portion 454 and is allowed to swing up and down, as shown in FIG. 40 and FIG. 41. And in this embodiment, driving unit 100 described previously with reference to FIGS. 1 to 13 is provided. One end 128 of core 120 provided in driving unit 100 protrudes from housing 102 and is coupled to link mechanism 458. And reciprocating linear motion shown by arrow A is converted to swinging motion of shower part 410 (power transmission part having converting mechanism). In addition, water discharged from core inner channel 124 (See FIG. 1) is supplied to shower part 410 via the fixed water guide channel described previously with reference to the fourth embodiment or a flexible water guide pipe or the like.

Also in this embodiment, by selecting properly a size or the like of driving unit 100 and link mechanism 458, periodicity of swinging motion of shower part 410 can be about a few hertz. As a result, comfortable feeling of massage and effect of working out of stiffness can be given to users.

Also in this embodiment, by providing switch 420, bypass channel 340 and switching valve 342 described previously with reference to FIGS. 32 to 38, turning on and off swinging motion of shower part 410 is possible depending on user's preference. Furthermore, in the state of making shower part 410 stop, the water sprinkle direction can be also changed by pushing manually.

'Swinging motion' in this embodiment means by action of the shower part described above. That is, the shower part having the sprinkle port has a swinging axis, and the shower part swings about the axis. At this time, the water sprinkle plane of the shower part is substantially parallel (the opening direction of the sprinkle port of the shower part is substantially perpendicular) to the swinging axis. In this way, the region allowing the shower part to exist can be reduced and maintained to be substantially constant while discharging water in a broad area by swinging action of the shower part, therefore, the shower device with improved design can be realized. Moreover, the swinging axis is preferred to be provided close to the sprinkle port of the shower part. Furthermore, in the state of the shower device installed, the sprinkle port is preferred to be provided more forward than the swinging axis. In addition, because the shower part is that swings vertically, the swinging axis in this embodiment is provided substantially parallel to a floor surface.

Next, a fifth embodiment of the shower device with driving unit 100 described above (embodiment of the core reciprocating linear motion) or driving unit 200 (embodiment of the core oscillating) is described in detail.

Figure 42:
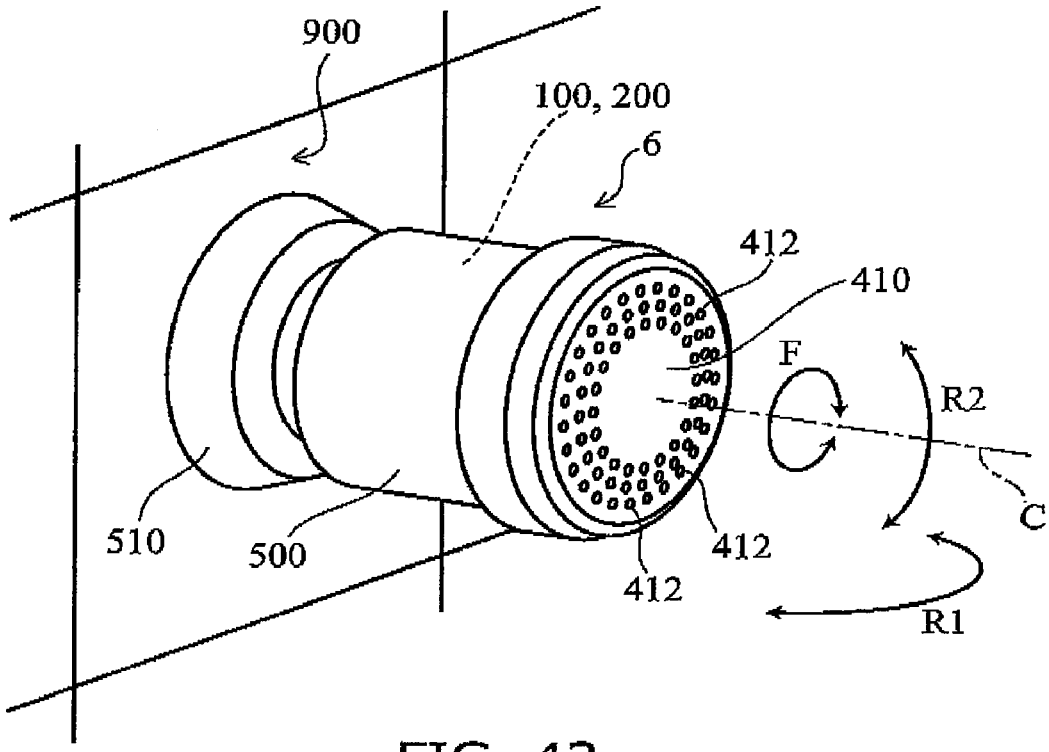
FIG. 42 is a schematic view showing a part of shower device 6 according to a fifth embodiment of the invention.

FIG. 42 is a schematic view showing a part of shower device 6 according to a fifth embodiment of the invention.

Shower device 6 of this embodiment can be used as a body shower, for example, by installing on wall 900 in a shower booth and a bathroom or the like. Moreover, the shower device 6 of this embodiment can be also used as an overhead shower by installing on a ceiling of a shower booth and a bathroom or the like.

In the interior of body 500, driving unit 100 described previously with reference to FIGS. 1 to 13 or driving unit 200 described previously with reference to FIGS. 14 to 20 is provided. Moreover, shower part 410 is provided in front of body 500. Shower part 410 is allowed to swing up and down shown by arrow R1 or right and left shown by arrow R2 by operation of driving unit 100 (or 200).

Furthermore, body 500 is allowed to be adjustable of the direction up and down or right and left with respect to supporting portion 510. That is, water sprinkle direction can be adjusted depending on the installation location of shower device 5 and user's preference or the like. Furthermore, body 500 may be also rotatable manually about an axis C as shown by arrow F with respect to supporting portion 510. In this way, swinging direction of shower part 410 can be freely adjusted to the right and left direction shown by arrow A (state of swinging axis substantially parallel to floor surface), to the up and down direction shown by arrow B (state of swinging axis substantially perpendicular to floor surface) and to the intermediate slanted direction between those (state of swinging axis neither parallel nor perpendicular to floor surface), too.

Furthermore, also in this embodiment, by providing switch 420, bypass channel 340 and switching valve 342 described previously with reference to FIGS. 32 to 38, turning on and off swinging motion of shower part 410 is possible depending on user's preference. Furthermore, in the state of making shower part 410 stop, the water sprinkle direction can be also changed by pushing manually.

Shower device 6 of this embodiment can be easily installed using shower coupling port already existing, because of no necessity to embed in wall 900 in a shower booth and a bathroom. As a result, comfortable feeling of massage and effect of working out of stiffness caused by automatic swinging motion of shower part 410 can be easily achieved.

'Swinging motion' in this embodiment means by action of the shower part described above. That is, the shower part having the sprinkle port has a swinging axis, and the shower part swings about the axis. At this time, the water sprinkle plane of the shower part is substantially parallel (the opening direction of the sprinkle port of the shower part is substantially perpendicular) to the swinging axis. In this way, the region allowing the shower part to exist can be reduced and maintained to be substantially constant while discharging water in a broad area by swinging action of the shower part, therefore, the shower device with improved design can be realized.

Up to this point the embodiment of the invention has been described. However, the invention is not limited to these examples.

That is, any ones to which a person skilled in the art added design modification with respect to any element comprising the shower device of the invention are also encompassed with the scope of the invention as long as they include the features of the invention. For example, any ones to which a person skilled in the art added modification properly with respect to outer shape of the driving unit of the shower device and the shower part, shape or location of components, and stroke and angle of swing or the like are also encompassed with the scope of the invention as long as they include the features of the invention.

Moreover, in each embodiment described above, a speed adjusting means may be provided, which adjusts the speed of swinging motion or the speed of reciprocating linear motion of the shower part driven by the driving unit. The speed adjusting means like this can be realized, for example, by providing a sliding member producing a variable sliding resistance to the water discharge tubular body, and by providing the bypass channel between two pressure chambers and the switching valve controlling the amount of flow in the bypass channel. Providing the speed adjusting means like this allows the speed of swinging motion of the shower part to change and further the speed of swinging motion of the shower part to stop while sprinkling shower water from the shower part coupled to the driving unit. That is, it becomes to be possible for users to take shower sprinkle water stopping the shower part in a preferred sprinkle direction. For example, behaviors comes to be possible, which users get massage effect by operating shower intensively to a body part and wash their head by receiving shower water intensively to the head, then the user-friendly shower device can be provided.

Moreover, in each embodiment describe above, a stroke adjusting means may be provided, which adjusts the angle range of swinging motion or the stroke of reciprocating linear motion of the shower part driven by the driving unit. The stroke adjusting means like this can be realized, for example, by providing a variable end protruding into the pressure chamber in the housing of the driving unit and by ensuring that the end touches the slide bar of the core. By providing the stroke adjusting means, the swinging range and moving range of the shower part coupled to the driving unit can be adjusted and the change range of the direction of the shower sprinkle can be adjusted. That is, users can adjust the operation range of shower sprinkle depending on their preference. Moreover, the user-friendly and effective shower device can be provided, which does not sprinkle water in the useless area by adjusting the change range in agreement with the individual body type.

INDUSTRIAL APPLICABILITY

The invention can provide a shower device and a shower booth having a compact and simple structure and capable of automatic reciprocating action changing repetitively a direction of shower water sprinkle using water power.

What is claimed is:

1. A shower device comprising: a driving unit including a housing, which has space inside, and water being introduced inside the housing; and a core, which divides the space inside the housing into a first pressure chamber and a second pressure chamber, and reciprocates relative to the housing, the core reciprocating by a pressure of the water which is introduced into the housing; a shower part allowed to swing; a water guide channel introducing water which is introduced into the housing to the shower part; and a power transmission part transmitting the reciprocating motion of the core to the shower part, the core having a core inner channel communicating with the first and second pressure chambers via a valve body which reciprocates relative to the core, the water in the first and second pressure chambers being introduced into the core inner channel from drain holes in the core, wherein openings of the drain holes change with the valve body movement, and the core inner channel communicates with the water guide channel, the water introduced into the housing acting as a thrust of the reciprocating motion of the core and the water being sprinkled from the shower part via the core inner channel and the water guide channel.

2. The shower device according to claim 1, wherein the shower device is installable on a wall of a shower booth or a bathroom.

3. The shower device according to claim 1, wherein the housing has a fan-shaped space inside, and the core is allowed to oscillate in the fan-shaped space.

4. The shower device according to claim 3, wherein the power transmission part is coupled to an oscillating axis for the oscillating motion of the core.

5. The shower device according to claim 4, wherein the oscillating axis of the core is different from a swinging axis for the swinging motion of the shower part.

6. The shower device according to claim 1, wherein the housing has a columnar space inside, the core is allowed to reciprocate linearly in the columnar space, and the power transmission part includes a mechanism converting the reciprocating linear motion of the core into the swinging motion of the shower part.

7. The shower device according to claim 1, wherein the shower device is embeddable in a wall of a shower booth or a bathroom.

8. The shower device according to claim 1, wherein the shower part includes a plurality of shower sprinkle ports arranged two dimensionally.

9. The shower device according to claim 1, further comprising a speed adjusting means for stopping the swinging motion of the shower part while the shower part sprinkles water.

10. The shower device according to claim 9, wherein a sprinkle direction of the shower part is allowed to be changed while the swinging motion of the shower part is stopped.

11. The shower device according to claim 1, wherein at least a part of the water guide channel does not associate with the motion of the core.

12. A shower booth comprising:

a wall;

a ceiling; and the shower device according to claim 1 installed on at least one of the wall and the ceiling.

* * * * *